US010214370B2

(12) United States Patent
Sakurai

(10) Patent No.: US 10,214,370 B2
(45) Date of Patent: Feb. 26, 2019

(54) SHEET FEEDING APPARATUS AND IMAGE FORMING APPARATUS

(71) Applicant: CANON KABUSHIKI KAISHA, Tokyo (JP)

(72) Inventor: Yuta Sakurai, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/790,364

(22) Filed: Oct. 23, 2017

(65) Prior Publication Data

US 2018/0118481 A1 May 3, 2018

(30) Foreign Application Priority Data

Nov. 1, 2016 (JP) ..... 2016-214645

(51) Int. Cl.

| | |
|---|---|
| ***B65H 1/14*** | (2006.01) |
| ***B65H 3/06*** | (2006.01) |
| ***B65H 7/02*** | (2006.01) |
| ***G03G 15/00*** | (2006.01) |
| ***B65H 7/20*** | (2006.01) |

(52) U.S. Cl.

CPC ..... *B65H 1/14* (2013.01); *B65H 3/0607* (2013.01); *B65H 3/0684* (2013.01); *B65H 7/02* (2013.01); *B65H 7/20* (2013.01); *B65H 2407/21* (2013.01); *B65H 2511/13* (2013.01); *B65H 2511/414* (2013.01); *G03G 15/6514* (2013.01)

(58) Field of Classification Search

CPC ..... B65H 7/20; B65H 1/14; B65H 3/0607; B65H 2511/414; B65H 2407/21; G03G 15/6514

See application file for complete search history.

(56) References Cited

U.S. PATENT DOCUMENTS

| | | | | |
|---|---|---|---|---|
| 8,480,082 | B2 | 7/2013 | Kannari et al. | |
| 9,296,580 | B2 * | 3/2016 | Sung | H04N 1/00652 |
| 2010/0225053 | A1 | 9/2010 | Nakamura et al. | |
| 2017/0297838 | A1 * | 10/2017 | Hanamoto | B65H 3/0684 |
| 2018/0072521 | A1 * | 3/2018 | Okubo | B65H 3/0661 |

FOREIGN PATENT DOCUMENTS

| | | | |
|---|---|---|---|
| JP | 2000-118746 | A | 4/2000 |
| JP | 2000-264460 | A | 9/2000 |
| JP | 2002-187633 | A | 7/2002 |
| JP | 2010-202379 | A | 9/2010 |
| JP | 2012-017169 | A | 1/2012 |

* cited by examiner

*Primary Examiner* — Patrick Cicchino
(74) *Attorney, Agent, or Firm* — Venable LLP

(57) ABSTRACT

A sheet feed portion feeds a sheet by performing a pickup operation in a cycle in which a pickup rotary member is switched from a released state to a contact state and then switched to the released state. A detection unit detects the sheet at a position downstream of the sheet feed portion in the sheet feeding direction. A control unit is capable of executing a first feed mode in which a first feed process of carrying out a pickup operation is executed, or a second feed mode in which the first feed process is executed and then a second feed process of carrying out an additional pickup operation is executed. The mode to be executed is determined based on a time when the sheet is detected by the detection unit and a length of the sheet.

23 Claims, 15 Drawing Sheets

SHEET FEEDING APPARATUS AND IMAGE FORMING APPARATUS

BACKGROUND OF THE INVENTION

Field of the Invention

The present invention relates to sheet feeding apparatuses configured to feed sheets to apparatuses such as image forming apparatuses and to image forming apparatuses.

Description of the Related Art

Sheet feeding apparatuses adopted in image forming apparatuses such as printers, copying machines or facsimiles are usually equipped with a pickup member to pick up sheets supported on a sheet supporting portion, and a conveyance member to receive and convey the sheets fed by the pickup member. Further, some sheet feeding apparatuses adopt a configuration in which a pickup member is relatively moved with respect to the sheets along with the driving of the pickup member, so that the pickup member picks up the sheets one by one by performing a pickup operation in which the pickup member comes in contact with the sheet supported on the sheet supporting portion, and then the contact state is released.

Japanese Unexamined Patent Application Publication No. 2012-017169 discloses a sheet feeding apparatus in which a sheet supporting portion is lifted and lowered by a cam that rotates along with the rotation of a sheet feed roller. A sheet supported on the sheet supporting portion comes in contact with a sheet feed roller, and thereafter, the contact of the sheet with the sheet feed roller is released. This document also discloses a configuration in which after the sheet is fed from the sheet feed roller by the lifting of the sheet supporting portion, the sheet supporting portion is raised again so that the sheet contacts the sheet feed roller, thereby the sheet feed roller assisting the conveyance of the sheet by a registration roller pair.

However, in the course of improving stability of conveyance of sheets by carrying out pickup operations multiple times by the pickup member, there were cases where a sheet stacked below the uppermost sheet being fed, hereinafter referred to as a succeeding sheet, is picked up undesirably by the pickup member. For example, in a case where the pickup operation is executed twice by the pickup member, there were cases where a trailing edge of the uppermost sheet passes an abutment position, where the pickup member abut with sheets, before the second pickup operation is completed. Then the pickup member comes in contact with the succeeding sheet, such that the succeeding sheet starts moving. The succeeding sheet is fed from the sheet supporting portion along with the feeding of the uppermost sheet, thereby causing undesirable situations such as occurrence of multiple feeding of sheets.

SUMMARY OF THE INVENTION

The present invention provides a sheet feeding apparatus capable of preventing multiple feeding of sheets while realizing stable sheet conveyance.

According to one aspect of the present invention, a sheet feeding apparatus includes: a sheet supporting portion configured to support a sheet; a sheet feed portion comprising a pickup rotary member switchable between a contact state of being in contact with the sheet supported on the sheet supporting portion and a released state of being released from the contact state, the sheet feed portion being configured to feed the sheet supported on the sheet supporting portion by performing a pickup operation in a cycle in which the pickup rotary member is switched from the released state to the contact state and then switched to the released state; a sheet conveyance portion arranged downstream of the sheet feed portion in a sheet feeding direction of the sheet feed portion and configured to convey the sheet; a detection unit arranged downstream of the sheet feed portion in the sheet feeding direction and configured to detect the sheet; and a control unit comprising a processor and configured to control the sheet feed portion and the sheet conveyance portion, the control unit being configured to execute one of a plurality of modes including a first feed mode in which a first feed process of carrying out a pickup operation by the sheet feed portion is executed, the pickup rotary member being retained in the released state after the first feed process in the first feed mode, and a second feed mode in which the first feed process is executed, and then a second feed process of carrying out a pickup operation by the sheet feed portion is executed, wherein in a case where the sheet is detected by the detection unit during a period from a start to an end of the first feed process, the control unit is configured to determine a mode to be executed among the plurality of modes based on a time from when the first feed process is started to when the sheet is detected by the detection unit and a length of the sheet in the sheet feeding direction fed by the sheet feed portion.

According to another aspect of the present invention, a sheet feeding apparatus includes: a sheet supporting portion configured to support a sheet; a sheet feed portion comprising a pickup rotary member switchable between a contact state of being in contact with the sheet supported on the sheet supporting portion and a released state of being released from the contact state, the sheet feed portion being configured to feed the sheet supported on the sheet supporting portion by performing a pickup operation in a cycle in which the pickup rotary member is switched from the released state to the contact state and then switched to the released state; a sheet conveyance portion arranged downstream of the sheet feed portion in a sheet feeding direction of the sheet feed portion and configured to convey the sheet; and a control unit comprising a processor and configured to control the sheet feed portion and the sheet conveyance portion, the control unit being configured to execute one of a plurality of modes including a first feed mode in which a first feed process of carrying out a pickup operation by the sheet feed portion is executed, the pickup rotary member being retained in the released state after the first feed process in the first feed mode, and a second feed mode in which the first feed process is executed, and then a second feed process of carrying out a pickup operation by the sheet feed portion is executed, wherein the control unit is configured to execute the first feed mode in a case of feeding a sheet having a first length in the sheet feeding direction and to execute the second feed in a case of feeding a sheet having a second length longer than the first length in the sheet feeding direction.

According to still another aspect of the present invention, an image forming apparatus includes: an image forming portion configured to form an image on a sheet; and a sheet feeding apparatus configured to feed the sheet to the image forming portion. The sheet feeding apparatus includes: a sheet supporting portion configured to support a sheet; a sheet feed portion comprising a pickup rotary member switchable between a contact state of being in contact with the sheet supported on the sheet supporting portion and a released state of being released from the contact state, the sheet feed portion being configured to feed the sheet supported on the sheet supporting portion by performing a pickup operation in a cycle in which the pickup rotary member is switched from the released state to the contact state and then switched to the released state; a sheet conveyance portion arranged downstream of the sheet feed portion in a sheet feeding direction of the sheet feed portion and configured to convey the sheet; a detection unit arranged downstream of the sheet feed portion in the sheet feeding direction and configured to detect the sheet; and a control unit comprising a processor and configured to control the sheet feed portion and the sheet conveyance portion, the control unit being configured to execute one of a plurality of modes including a first feed mode in which a first feed process of carrying out a pickup operation by the sheet feed portion is executed, the pickup rotary member being retained in the released state after the first feed process in the first feed mode, and a second feed mode in which the first feed process is executed, and then a second feed process of carrying out a pickup operation by the sheet feed portion is executed, wherein in a case where the sheet is detected by the detection unit during a period from a start to an end of the first feed process, the control unit is configured to determine a mode to be executed among the plurality of modes based on a time from when the first feed process is started to when the sheet is detected by the detection unit and a length of the sheet in the sheet feeding direction fed by the sheet feed portion.

Further features of the present invention will become apparent from the following description of exemplary embodiments with reference to the attached drawings.

DESCRIPTION OF THE EMBODIMENTS

Now, a sheet feeding apparatus according to the present disclosure will be described with reference to the drawings.

First Embodiment

Figure 1:
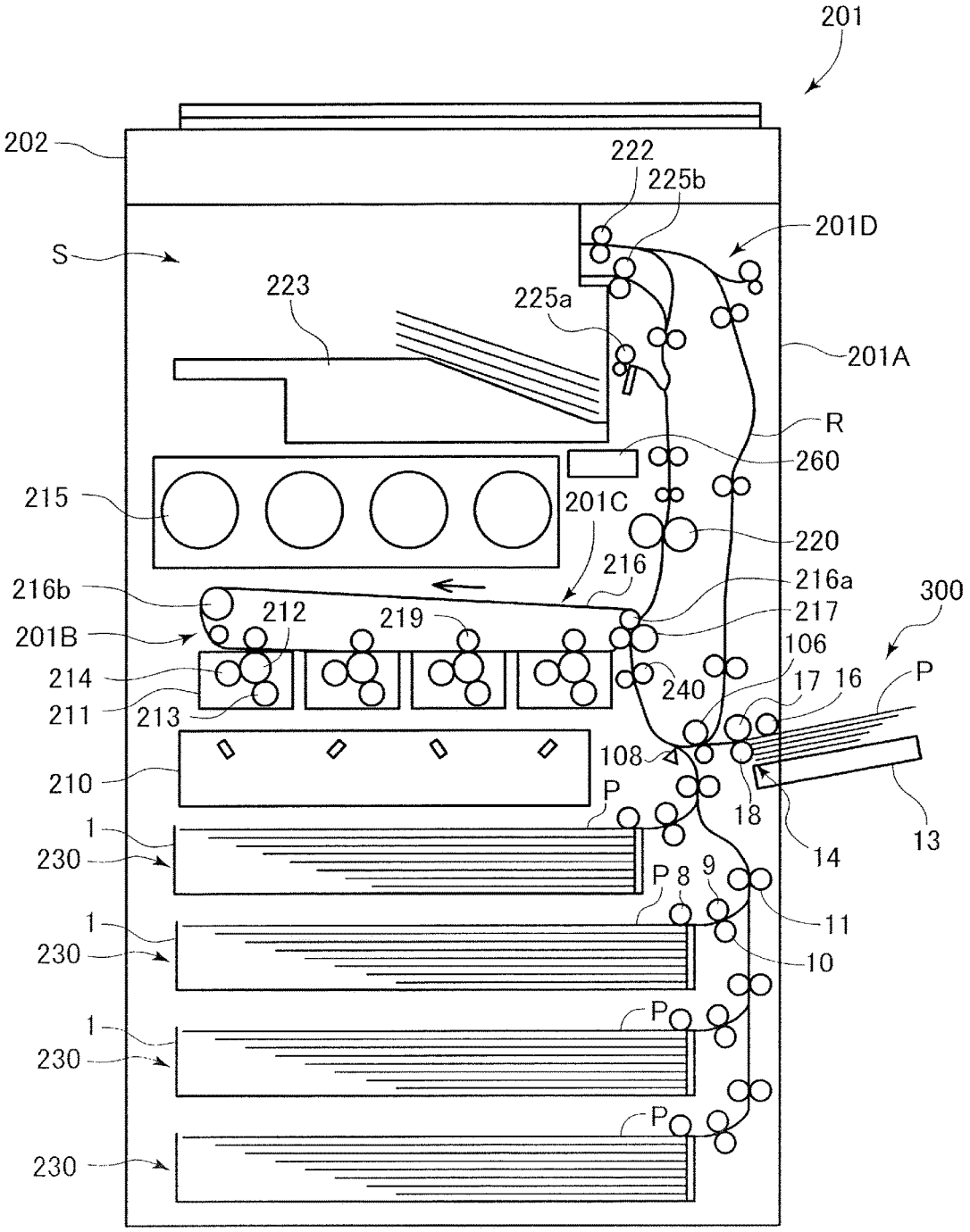
FIG. 1 is a schematic view illustrating a configuration of an image forming apparatus according to a first embodiment.

As illustrated in FIG. 1, a sheet feeding apparatus according to a first embodiment is provided as a portion of a full-color laser beam printer 201, hereinafter referred to as printer, serving as an example of an image forming apparatus. The printer 201 includes a printer body 201A serving as an image forming apparatus body, an image forming portion 201B configured to form an image on a sheet, and an image reading apparatus 202 disposed substantially horizontally on an upper portion of the printer body 201A. The printer 201 is a so-called in-body sheet discharge-type image forming apparatus in which a sheet discharge space S into which sheets are discharged is formed between the image reading apparatus 202 and the printer body 201A.

A plurality of sheet feeders 230 are provided in a lower portion of the printer body 201A, and are each equipped with a sheet feed cassette 1 serving as a sheet storage portion capable of storing sheets P. Each sheet feeder 230 is equipped with a pickup roller 8 serving as a pickup rotary member that feeds sheets from the sheet feed cassette 1, and a separating and conveying portion composed of a feeding roller 9 and a retard roller 10. The sheet P fed by the pickup roller 8 is conveyed by the feeding roller 9 while being separated from other sheets by the retard roller 10, to which a driving force in an opposite direction with respect to the sheet feeding direction is entered. The sheet P transmitted from the feeding roller 9 is conveyed upward by a drawing roller pair 11, and supplied via a registration roller pair 240 to an image forming portion 201B. A manual sheet feeder 300 described later as a manual sheet-feed-type sheet feeding apparatus, on which a user can set sheets from an exterior of the apparatus, is arranged on a side portion of the printer body 201A. The configuration of the manual sheet feeder 300 will be described later.

The image forming portion 201B, which is an example of an image forming portion, is a four-drum full color electrophotographic unit. The image forming portion 201B is equipped with a laser scanner 210, and four process cartridges 211 configured to form toner images of four colors, which are yellow (Y), magenta (M), cyan (C) and black (K). Each process cartridge 211 is equipped with a photosensitive drum 212 composed of a drum-shaped photoconductor, a charging unit 213 serving as a charging member, and a developing unit 214 serving as a developing portion. Further, the image forming portion 201B is equipped with an intermediate transfer unit 201C arranged above the process cartridges 211, and a fixing portion 220. A plurality of toner cartridges 215 for supplying toner to the corresponding developing units 214 are mounted above the intermediate transfer unit 201C.

The intermediate transfer unit 201C includes an intermediate transfer belt 216 wound around a drive roller 216*a* and a tension roller 216*b*. On an inner side of the intermediate transfer belt 216 are provided primary transfer rollers 219 that are abutted against the intermediate transfer belt 216 at positions opposing to the photosensitive drums 212. The intermediate transfer belt 216 is rotated in an arrow direction in the drawing by the drive roller 216*a* that is driven by a driving unit not shown.

A secondary transfer roller 217 configured to transfer a color image borne on the intermediate transfer belt 216 to a sheet P is provided at a position opposing to the drive roller 216*a* of the intermediate transfer unit 201C. Further, the fixing portion 220 is arranged above the secondary transfer roller 217, and a first sheet discharge roller pair 225*a*, a second sheet discharge roller pair 225*b* and a reverse conveyance portion 201D are arranged above the fixing portion 220. The reverse conveyance portion 201D includes a reverse conveyance roller pair 222 that can be rotated in forward and reverse directions, and a re-conveyance path R that connects the reverse conveyance roller pair 222 and the image forming portion 201B. Further, a control unit 260 configured to perform integrated control of the operation of the printer 201 including image forming operations performed by the image forming portion 201B is installed in the printer body 201A.

Next, an image forming operation of the printer 201 will be described, taking a copying operation as an example. When image information of a document is read by the image reading apparatus 202, the image information is subjected to image processing, and then converted into electric signals and transmitted to the laser scanner 210 of the image forming portion 201B. In the image forming portion 201B, the photosensitive drums 212, whose surfaces are uniformly charged to predetermined polarity and potential by the charging unit 213, are sequentially exposed by laser beams. Thereby, electrostatic latent images corresponding to single-color images of yellow, magenta, cyan and black are sequentially formed on the surfaces of the photosensitive drums 212 of the respective process cartridges 211.

These electrostatic latent images are developed and visualized by respective colored toners supplied from the developing units 214. The toner images borne on the respective photosensitive drums 212 are transferred in a superposed manner in multiple layers to the intermediate transfer belt 216 by bias voltage applied to the primary transfer roller 219. Thereby, a toner image is formed on the intermediate transfer belt 216.

Simultaneously as the above-described process of forming the toner image, a sheet P is supplied from the sheet feeder 230 or the manual sheet feeder 300 to the registration roller pair 240. The registration roller pair 240 holds and stops a leading edge of the sheet P, that is, a downstream end in a sheet conveyance direction, to correct skew feed. Further, the registration roller pair 240 conveys the sheet P toward a secondary transfer portion formed between the secondary transfer roller 217 and the intermediate transfer belt 216 matching the forming of a toner image by the image forming portion 201B. In the secondary transfer portion, the toner image borne on the intermediate transfer belt 216 is collectively transferred to the sheet P by bias voltage applied to the secondary transfer roller 217. The sheet P to which the toner image has been transferred is conveyed to the fixing portion 220. The respective colored toner is subjected to heat and pressure at the fixing portion 220, being melted and mixed, and the toner image is fixed as color image to the sheet P.

The sheet P having passed the fixing portion 220 is discharged into a sheet discharge space S by the first sheet discharge roller pair 225*a* or the second sheet discharge roller pair 225*b* each disposed downstream of the fixing portion 220, and supported on a supporting portion 223 arranged downstream of the sheet discharge space S. In forming images on both sides of the sheet P, the sheet P having passed the fixing portion 220 is conveyed to a re-conveyance path R after being subjected to switch-back by the reverse conveyance roller pair 222, and conveyed again to the image forming portion 201B. The sheet P having a toner image transferred to a back side thereof and having the image fixed at the fixing portion 220 is discharged into the sheet discharge space S by the first sheet discharge roller pair 225*a* or the second sheet discharge roller pair 225*b*.

Manual Sheet Feeder

Next, a configuration of the manual sheet feeder 300 as an example of the sheet feeding apparatus will be described. As illustrated in FIG. 1, the manual sheet feeder 300 includes a sheet feed unit 14 including a pickup roller 16, a feeding roller 17 and a retard roller 18, a manual feed tray 13, and a drawing roller pair 106.

The manual feed tray 13 is supported on a right side surface of the printer body 201A in an openable/closable manner pivoting around a bottom portion of the manual feed tray 13. The pickup roller 16, serving as a pickup rotary member, is arranged above the manual feed tray 13 and feeds the sheet P supported on the manual feed tray 13 toward the feeding roller 17. The feeding roller 17, serving as the conveyance roller, conveys the sheet P received from the pickup roller 16 toward the drawing roller pair 106 while separating the sheets by the retard roller 18. The drawing roller pair 106 conveys the sheet P received from the feeding roller 17 toward the registration roller pair 240.

The manual feed tray 13 is one example of a sheet supporting portion configured to support sheets, and the sheet feed unit 14 is one example of a sheet feed portion configured to feed the sheet supported on the sheet supporting portion. Further, the drawing roller pair 106 and the registration roller pair 240 are examples of the sheet conveyance portions configured to convey sheets downstream of the sheet feed portion. The direction of movement of the sheet conveyed sequentially by the pickup roller 16, the feeding roller 17, the drawing roller pair 106 and the registration roller pair 240 is referred to as the sheet feeding direction hereinafter.

Figure 2:
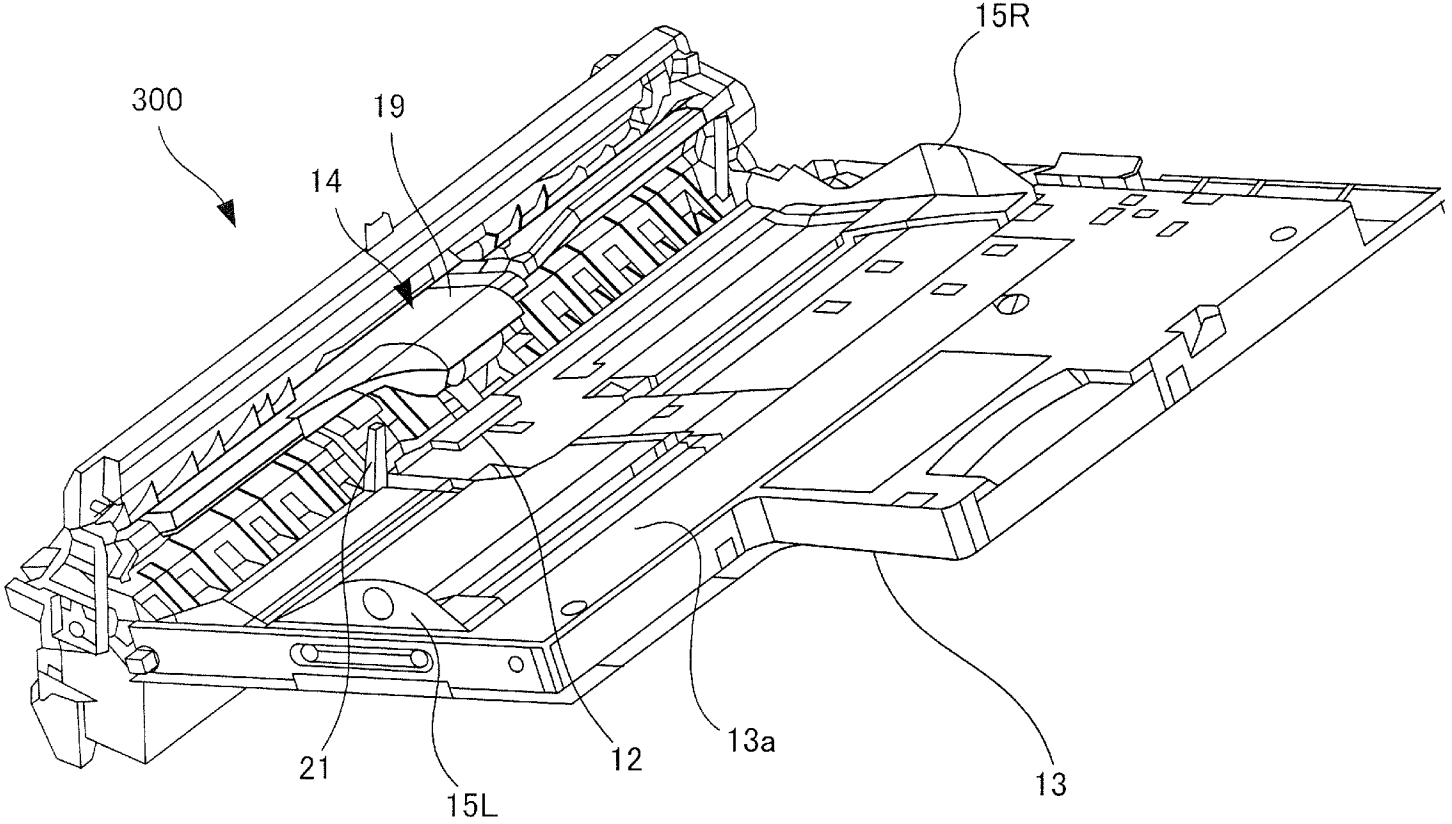
FIG. 2 is a perspective view of a manual sheet feeder according to the first embodiment.

As illustrated in FIG. 2, a pair of side regulating plates 15L and 15R that are relatively movable in a sheet width direction, that is, direction orthogonal to the sheet feeding direction, are provided on the manual feed tray 13. A flag-type sheet detection sensor 21 capable of detecting the presence or absence of the sheet on the tray, and a final sheet detection unit 12 capable of detecting whether the sheet being fed is a final sheet, are arranged at a downstream portion in the sheet feeding direction of a supporting surface 13*a* of the manual feed tray 13. The final sheet detection unit 12 is, for example, an optical sensor, or a rolling member connected to a rotation detecting mechanism, which is configured to detect relative movement of the sheet with respect to the supporting surface 13*a*.

Figure 3:
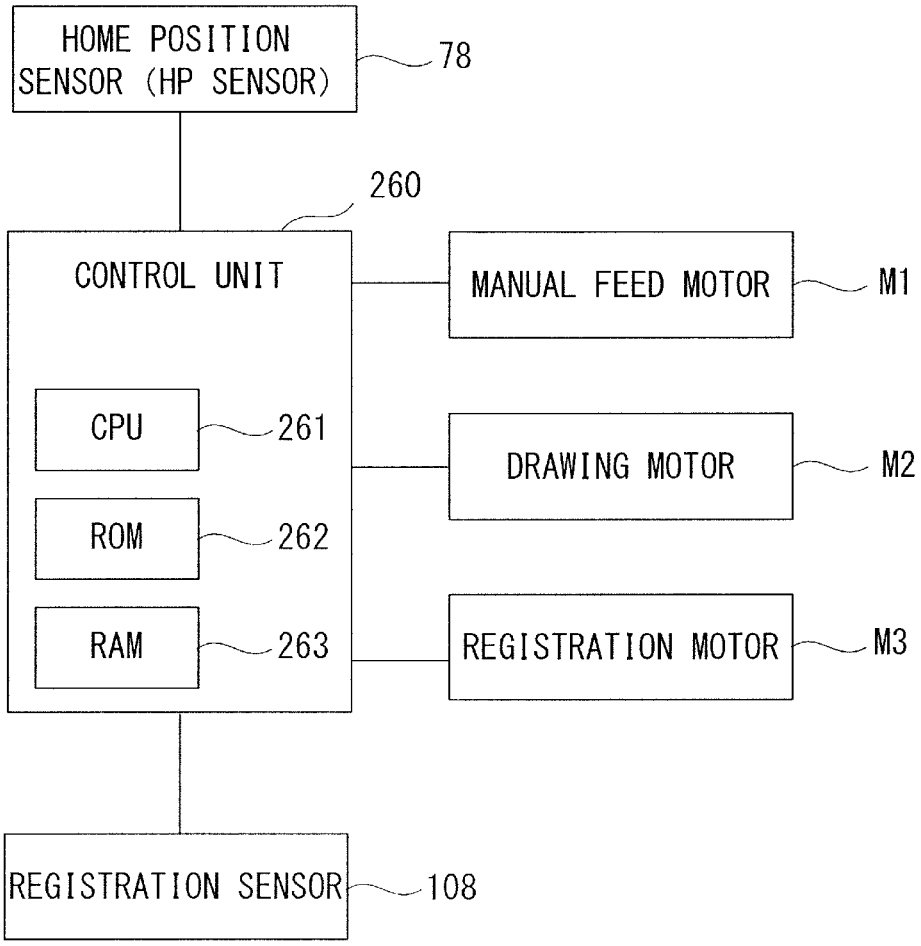
FIG. 3 is a block diagram illustrating a control configuration for the manual sheet feeder according to the first embodiment.

As illustrated in FIG. 3, the operation of the manual sheet feeder 300 is controlled by the control unit 260 installed in the printer body 201A. A manual feed drive motor M1 drives the sheet feed unit 14, a drawing motor M2 drives the drawing roller pair 106, and a registration motor M3 drives the registration roller pair 240. The control unit 260 controls actuators including these motors M1 to M3 by a central processing unit (CPU) 261 reading out control programs and setting data stored in a storage portion of a read only memory (ROM) 262. Further, the control unit 260 is capable of detecting the state of the manual sheet feeder 300 based on input signals from sensors including a manual sheet feed home position sensor (hereinafter referred to as HP sensor) 78 described later and a registration sensor 108. The RAM 263 serving as a rewritable memory is used as a working memory while the CPU 261 executes programs.

Figure 4A:
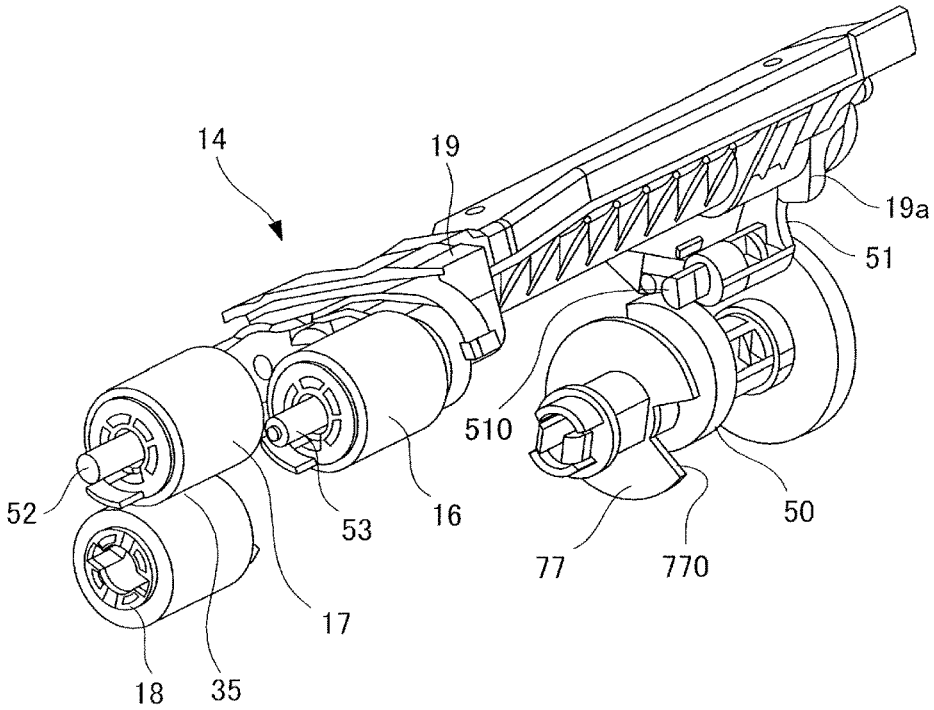
FIG. 4A is a perspective view of a sheet feed unit according to the first embodiment.
Figure 4B:
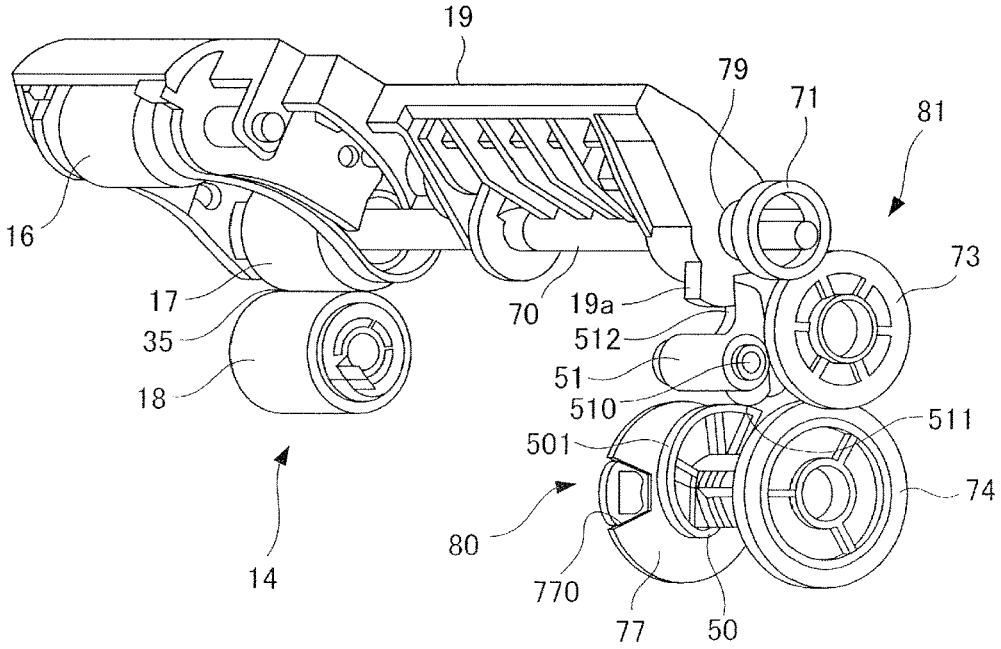
FIG. 4B is a perspective view, from another viewpoint, of a sheet feed unit according to the first embodiment.

As illustrated in FIGS. 4A and 4B, the pickup roller 16 is supported rotatably by a pickup arm 19 serving as a retaining portion retaining a pickup rotary member. FIGS. 4A and 4B are perspective views illustrating a relevant portion of the manual sheet feeder 300, wherein members of the manual sheet feeder 300 are partially omitted. The pickup arm 19 is pivotable around a roller shaft 52 of the feeding roller 17, and moves in a vertical direction, or the gravity direction, with respect to the manual feed tray 13 by being driven by a cam mechanism 80 described later.

The pickup roller 16 moves along with the movement of the pickup arm 19 between an abutment position where it abuts with a sheet supported on the manual feed tray 13 and a standby position where it is separated in an upper direction from the sheet supported on the manual feed tray 13. That is, the pickup roller 16 switches to a contact state in which the roller contacts the sheet supported on the manual feed tray 13 by the lowering of the pickup arm 19, and switches to a released state in which the roller is released from the contact state by the lifting of the pickup arm 19.

The feeding roller 17 is connected to the manual feed drive motor M1 via a drive shaft 70 arranged coaxially as the roller shaft 52 and a drive gear 71 attached to the drive shaft 70. The drive gear 71 has a one-way clutch mechanism built therein, and the clutch mechanism regulates the feeding roller 17 from idling in a direction, hereinafter referred to as a returning direction, opposing to the sheet feeding direction. That is, the feeding roller 17 is relatively rotatable in the direction along the sheet feeding direction, hereinafter referred to as a forward direction, with respect to the drive gear 71, while being regulated from relatively rotating in the returning direction.

The retard roller 18 serving as a separation member capable of separating a sheet conveyed by the feeding roller 17 from other sheets is arranged in contact with the feeding roller 17 by an urging member such as a spring. A separation portion 35 in which sheets are separated is formed between the feeding roller 17 and the retard roller 18. Further, the retard roller 18 is connected via a torque limiter to the drive gear 71, and configured to receive driving force in the returning direction from the manual feed drive motor Ml. Therefore, the pickup roller 16, the feeding roller 17 and the retard roller 18 are driven by a common drive source, the manual feed drive motor M1.

A separation pressure of the retard roller 18, that is, a contact pressure between rollers at the separation portion 35, and a torque value of the torque limiter, are set properly in consideration of followability and separating capability of the retard roller 18. That is, if one sheet exists in the separation portion 35, or if no sheet exists in the separation portion 35, the retard roller 18 rotates in the feeding direction, following the rotation of the feeding roller 17. Meanwhile, in the state where two or more sheets exist in the separation portion 35, the retard roller 18 rotates in the returning direction against the frictional force between sheets, and pushes back the sheets other than the uppermost sheet in contact with the feeding roller 17 toward an upstream side in the sheet feeding direction.

A roller shaft 53 of the pickup roller 16 is connected via a driving mechanism such as a gear train including an idler gear or a driving belt to the drive shaft 70. Therefore, the pickup roller 16 and the feeding roller 17 are driven simultaneously in the forward direction by the manual feed drive motor M1.

As illustrated in FIG. 4B, the cam mechanism 80 includes a cam 50, and a cam follower 51 intervened between the cam 50 and the pickup arm 19. The cam 50 is connected via a gear train 81 to the drive gear 71. The gear train 81 includes a cam driving gear 74 that rotates integrally with the cam 50, and an idler gear 73 engaged with the cam driving gear 74 and the drive gear 71. Therefore, the cam 50 rotates by being driven by the manual feed drive motor M1 serving as a common drive source as the pickup roller 16.

Figure 5:
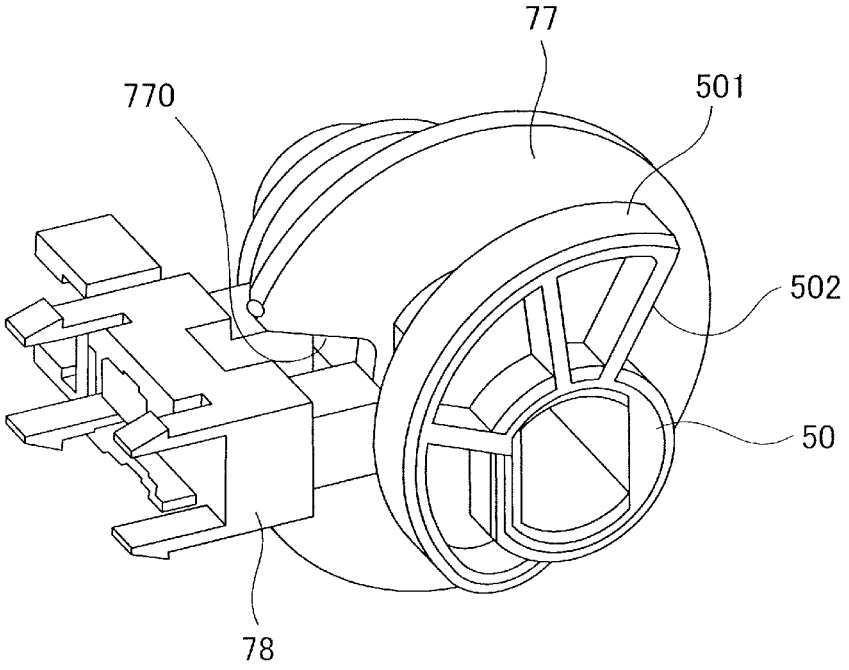
FIG. 5 is a perspective view illustrating a home position sensor of the sheet feed unit according to the first embodiment.

The cam follower 51 includes a first abutment portion 511 that abuts against a cam surface 501 of the cam 50, a second abutment portion 512 that abuts against a pressing portion 19*a* of the pickup arm 19, and the cam follower 51 is pivotable around a cam follower shaft 510. Meanwhile, the pickup arm 19 is urged downward by an urging spring 79 as an example of the urging member. The cam surface 501 has an outer diameter that differs according to rotation phases, and the cam surface 501 is arranged such that in a state where the first abutment portion 511 is pressed by the cam surface 501, the pickup arm 19 is pushed upward against the urging force of the urging spring 79. Further, as illustrated in FIG. 5, an HP sensor 78 serving as an angle detection unit capable of detecting a rotation angle of the cam 50 is a transmission type optical sensor, or a thru-beam photoelectric detector capable of detecting a cutout portion 770 of an HP sensor flag 77 rotating integrally with the cam 50. The HP sensor 78 is a position detection unit that detects information related to a position of the cam 50, and the control unit 260 is capable of detecting every one rotation of the cam 50 based on a detection result by the HP sensor 78.

Figure 6A:
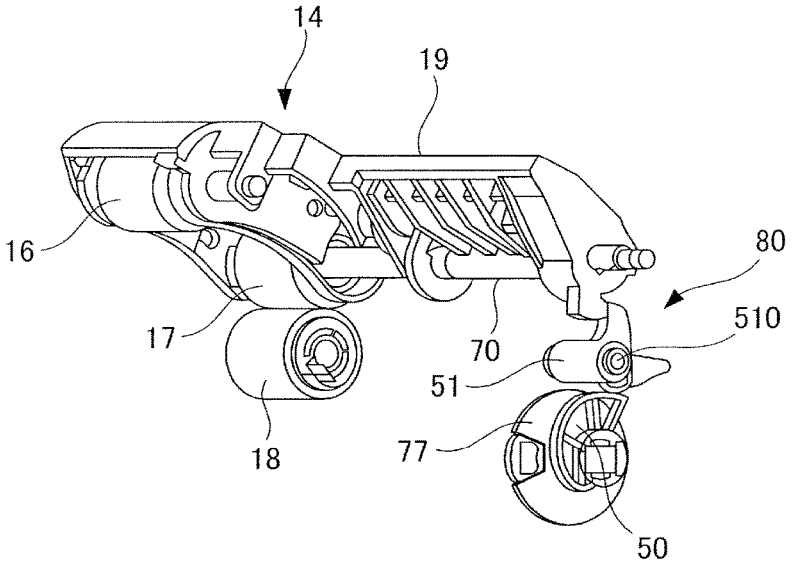
FIG. 6A is a perspective view illustrating a first stage of pickup operation of a pickup roller according to the first embodiment.
Figure 6B:
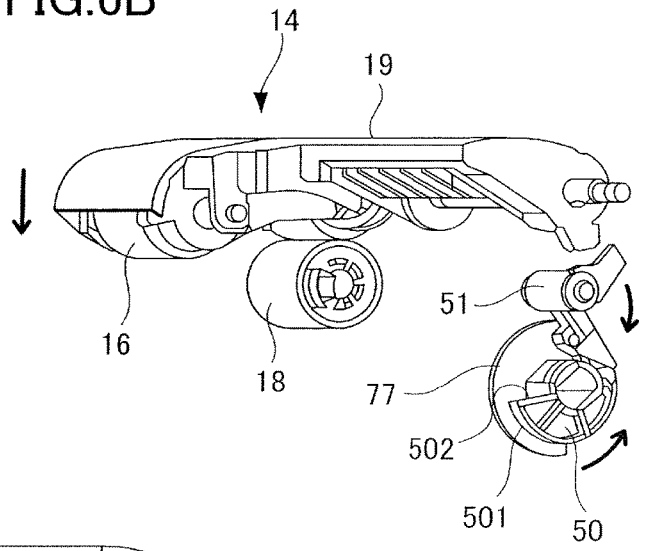
FIG. 6B is a perspective view illustrating a second stage of the pickup operation.
Figure 6C:
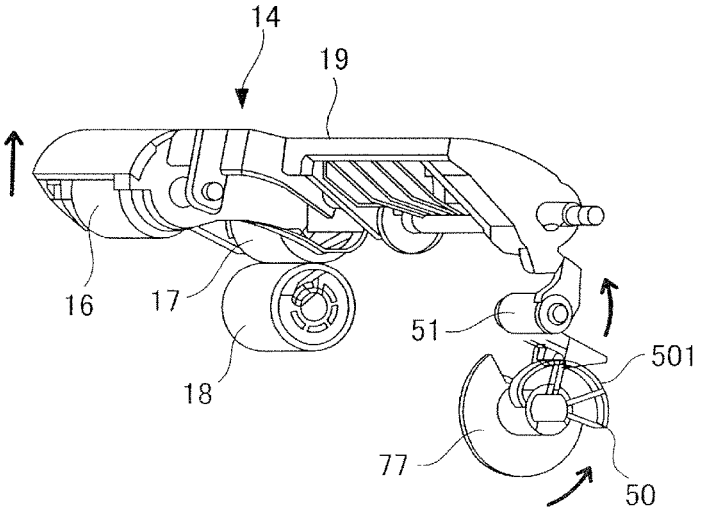
FIG. 6C is a perspective view illustrating a third stage of the pickup operation.

As illustrated in FIGS. 6A to 6C, the pickup roller 16 moves to the standby position and the abutment position along with the ascending and descending movement of the pickup arm 19 by the cam mechanism 80. In other words, the cam mechanism 80 is an example of a switching mechanism capable of switching the pickup roller 16 between the contact state and the released state. As illustrated in FIG. 6A, in a state where the pickup roller 16 is at an initial position, that is, in a standby position, the cam follower 51 is pushed up by the cam surface 501 of the cam 50, and the pickup arm 19 is retained at an upper position by the cam follower 51. In a state where the pickup roller 16 is in the standby position, the HP sensor 78 is arranged to be in an ON state, that is, in a state where the cutout portion 770 of the HP sensor flag 77 is detected.

If a driving force from the manual feed drive motor M1 is entered to the drive gear 71, the rotation of the drive gear 71 is entered to the cam 50 through the gear train 81 serving as a drive transmission mechanism. Then, as illustrated in FIG. 6B, the cam 50 starts rotating, and the HP sensor 78 is in an OFF state, in other words, light is blocked by the HP sensor flag 77. Then, when a stepped portion 502 of the cam surface 501 passes an abutment position with respect to the cam follower 51, the cam follower 51 is released from the cam 50 and becomes pivotable in a clockwise direction in the drawing. The pickup arm 19 released from the pressing force of the cam follower 51 descends by urging force of the urging spring 79 described above, and moves the pickup roller 16 to the abutment position.

When the cam 50 rotates further, as illustrated in FIG. 6C, the cam follower 51 is pushed up by the cam surface 501, and pivots in a counterclockwise direction in the drawing. Then, the pickup arm 19 pressed by the cam follower 51 ascends against the urging force of the urging spring 79, and moves the pickup roller 16 toward the standby position. Then, at a timing when the HP sensor 78 is turned ON again, the pickup roller 16 reaches the standby position (refer to FIG. 6A). As described, the pickup roller 16 performs a pickup operation in a cycle, in which the pickup roller moves from the standby position to the abutment position and then returns to the standby position, every time when the cam 50 makes one rotation.

Feeding Operation

Next, a feeding operation performed by the sheet feed unit 14 will be described with reference to FIGS. 7A to 7C. As described above, the driving force of the manual feed drive motor M1 entered to the drive gear 71 is not only transmitted via the gear train 81 to the cam 50, but also distributed to the pickup roller 16, the feeding roller 17 and the retard roller 18. Therefore, in a state where the cam 50 rotates, the respective rollers 16, 17 and 18 are driven to rotate along with the pickup operation of the pickup roller 16.

Figure 7A:
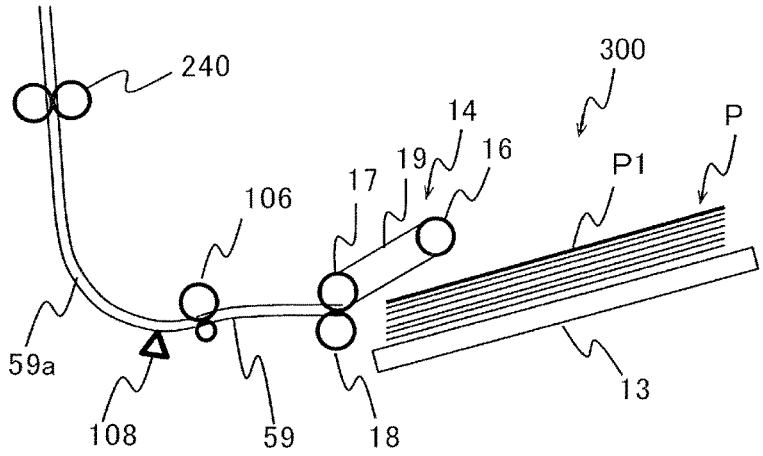
FIG. 7A is a frame format view illustrating a first stage of a feeding operation of a sheet feed unit according to the first embodiment.

As illustrated in FIG. 7A, the pickup roller 16 positioned at the standby position is separated from the sheet P supported on the manual feed tray 13. In a state where the manual feed drive motor M1 is operated, as illustrated in FIG. 7B, the pickup arm 19 descends and the pickup arm 19 moves to the abutment position, where the pickup roller 16 is abutted against an uppermost sheet P1. Then, the sheet P1 is fed by the rotation of the pickup roller 16, and the sheet starts moving downstream in the sheet feeding direction. The pickup roller 16 is retained in the abutment position longer than the period of time required for the sheet P to reach the separation portion 35.

The sheet P1 having reached the separation portion 35 is separated from a succeeding sheet by the retard roller 18, and conveyed further downstream in the sheet feeding direction by the feeding roller 17. The pickup roller 16 and the feeding roller 17 continue to rotate until the sheet P1 has reached the drawing roller pair 106. Then, at a timing after the leading edge of the sheet P1 reaches the drawing roller pair 106, the pickup roller 16 moves to the standby position.

Thereafter, the sheet P1 is conveyed by the drawing roller pair 106 and the registration roller pair 240 toward the image forming portion 201B, and a toner image is formed on the sheet P1 at the image forming portion 201B. The registration sensor 108 configured to detect the sheet is arranged between the drawing roller pair 106 and the registration roller pair 240, and the registration sensor 108 is used for controlling a feeding operation described later.

As described, the sheet feed unit 14 carries out a feeding operation as a set of operations specified by one cycle of the pickup operation by the pickup roller 16. In other words, the sheet feed unit 14 is capable of executing a feeding operation that is periodic with respect to the rotation amount of the cam 50, with a single rotation of the cam 50 set as the periodic cycle. Hereafter, a feed mode of the sheet feed unit 14 in a state where the cam 50 rotates once, that is, in a state where the pickup roller 16 performs a single pickup operation, is called a "single-rotation feeding". Similarly, a feed mode of the sheet feed unit 14 in a state where the cam 50 rotates twice is called a "double-rotation feeding".

The operation of the manual sheet feeder 300 according to the single-rotation feeding and the double-rotation feeding will be described with reference to FIGS. 8 and 9. FIGS. 8A and 9A are graphs illustrating the position of sheets respectively conveyed by single-rotation feeding and by double-rotation feeding, and FIGS. 8B and 9B are timing charts related to these feeding operations. In FIGS. 8B and 9B, as for the respective motors M1 to M3, the drive state is illustrated as 1 (High), and as for the respective rollers 16, 17, 106 and 240, the driven state is illustrated as 1 (High). As for the pickup roller 16, to indicate whether the roller is in contact with the sheet or not, a chart is illustrated to indicate a state in which the pickup roller 16 is positioned at the abutment position, i.e., contact state, as 1 (High), and a state in which the pickup roller 16 is positioned at the standby position, i.e., released state, as 0 (Low).

Single-Rotation Feeding

Figure 8A:
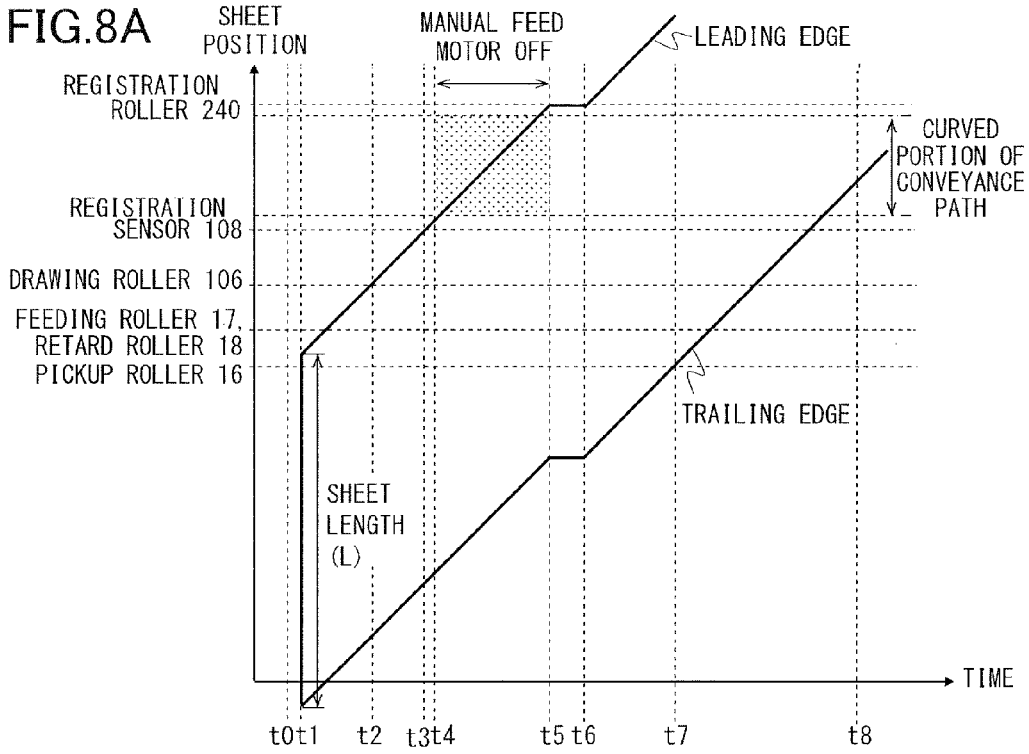
FIG. 8A is a graph illustrating a position of a sheet fed by single-rotation feeding in a manual sheet feeder according to the first embodiment.
Figure 8B:
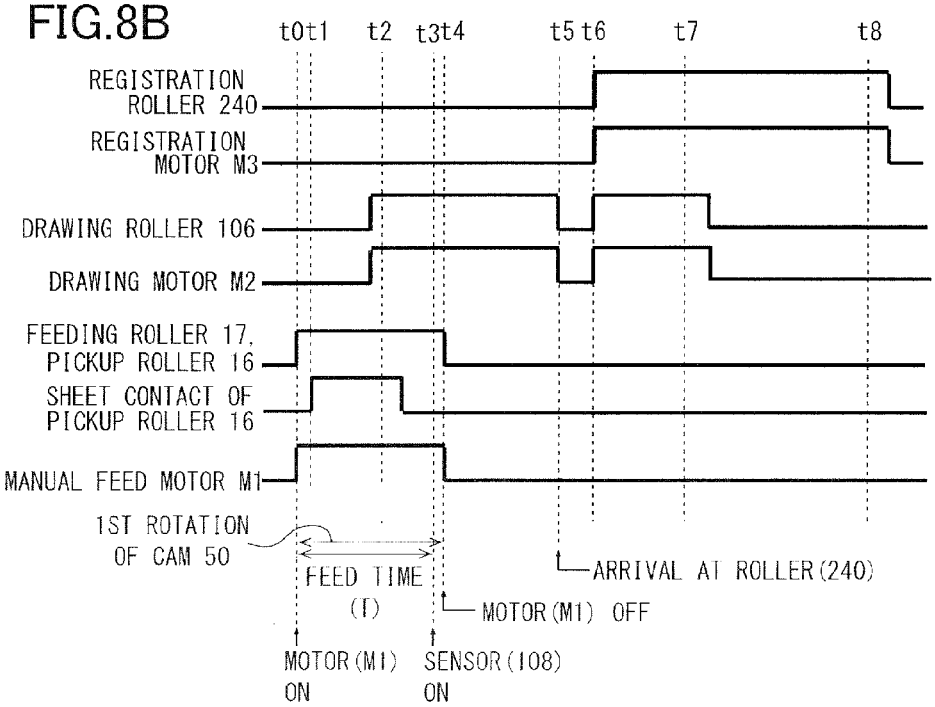
FIG. 8B is a timing chart of the single-rotation feeding.
Figure 9A:
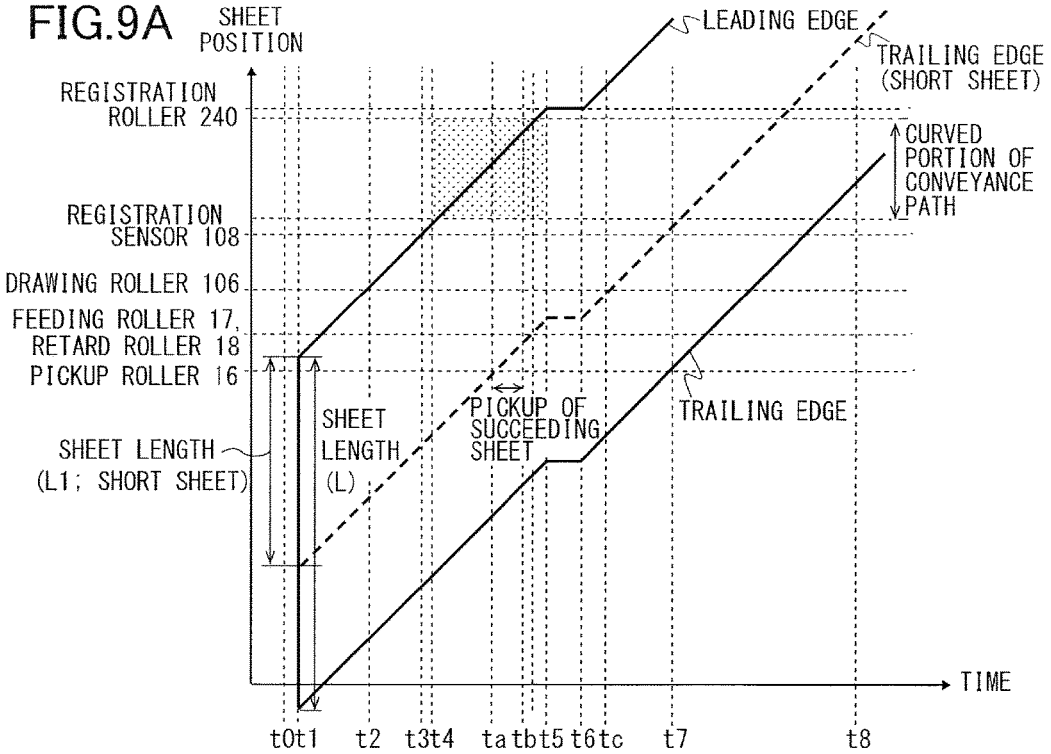
FIG. 9A is a graph illustrating a position of a sheet fed by double-rotation feeding in the manual sheet feeder according to the first embodiment.

As illustrated in FIGS. 8A and 8B, in single-rotation feeding, the driving of the manual feed drive motor M1 is started at first (at time t0), and along therewith, the pickup roller 16 and the feeding roller 17 start to rotate. Further, pickup operation is started by the cam mechanism 80, and the pickup roller 16 moves to the abutment position to be in contact with the sheet (at time t1). Thereby, the sheet in contact with the pickup roller 16 starts to move in the sheet feeding direction, that is, upward in FIG. 8A.

The drawing motor M2 is started earlier than a timing, i.e., timing (at time t2), in which a leading edge of the sheet reaches the drawing roller pair 106. Thereby, the sheet having passed through the separation portion 35 between the feeding roller 17 and the retard roller 18 is conveyed by the drawing roller pair 106 toward the registration roller pair 240. Further, during the process of moving toward the registration roller pair 240, the leading edge of the sheet is detected by the registration sensor 108 (at time t3).

Thereafter, if the HP sensor 78 detects that the cam 50 has rotated once, the driving of the manual feed drive motor M1 is stopped (at time t4). Thereafter, the pickup roller 16 is retained at the standby position, and drive force will not be entered to the pickup roller 16 and the feeding roller 17. Meanwhile, the drawing roller pair 106 is driven continuously to continue conveyance of the sheet, and stops temporarily at a stage where the leading edge of the sheet abuts against the registration roller pair 240 (at time t5).

The registration motor M3 starts along with the formation of a toner image by the image forming portion 201B, and rotates the registration roller pair 240 (at time t6). In synchronization therewith, the drawing motor M2 starts again, and the drawing roller pair 106 conveys the sheet together with the registration roller pair 240. Thereby, the sheet is fed to the secondary transfer portion, and a toner image formed by the image forming portion 201B is transferred to the sheet. The drawing motor M2 and the registration motor M3 stops sequentially along with the progress of conveyance of the sheet (at time t7 and t8). The above-described single-rotation feeding is executed repeatedly until forming of image to a designated number of sheets is completed.

Influence of Conveyance Resistance

There are various sizes and types of sheets used as recording media in the image forming apparatus. Types of sheets can be, for example, other than plain paper, special paper such as thick paper and coated paper, sheets having a special shape such as envelopes and index paper, plastic films such as OHP sheets, and cloth. It is known that the level of conveyance resistance, in an opposite direction to the conveyance direction of the sheet when conveying the sheet, differs according to sheet size and sheet type. One of the main causes of conveyance resistance is friction between a guide member forming the conveyance path and the sheet, so that the higher the stiffness of the sheet is, and the steeper the curve of the conveyance path is (or the smaller the radius of curvature is), the higher the conveyance resistance tends to be. Examples of sheets having a high stiffness include thick paper, coated paper, and an envelope.

Figure 7B:
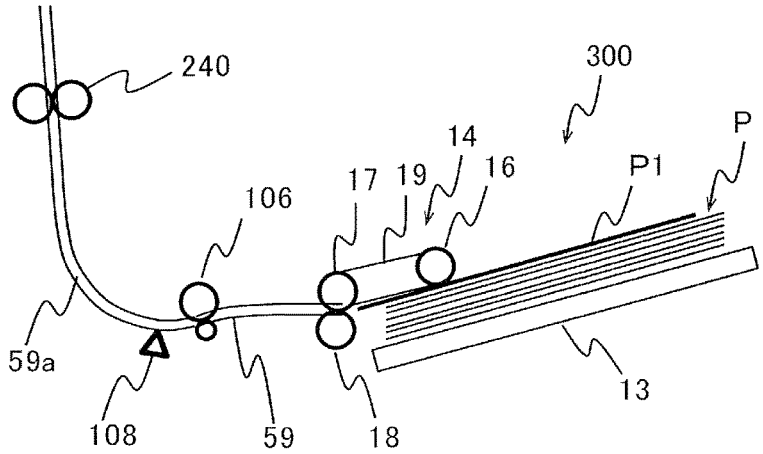
FIG. 7B is a view illustrating a second stage of the feeding operation.
Figure 7C:
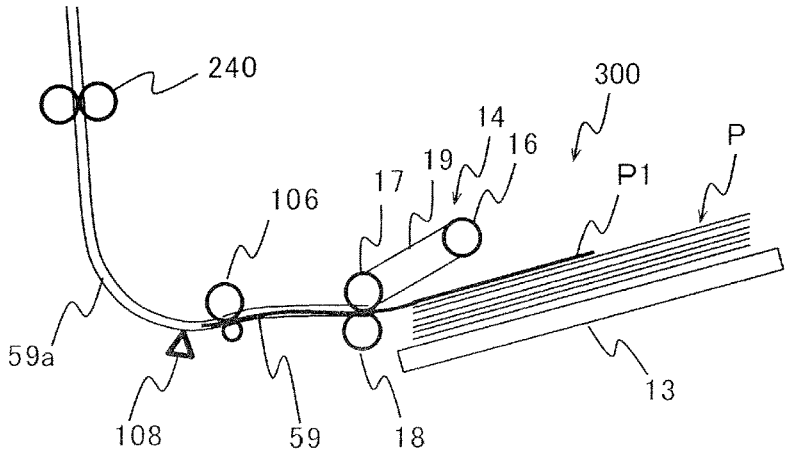
FIG. 7C is a view illustrating a third stage of the feeding operation.

In the example of the present embodiment, as illustrated in FIGS. 7A to 7C, a conveyance path 59 composed of a conveyance guide 590 and guiding the sheet fed by the sheet feed unit 14 includes a curved portion 59*a* curved when viewed from a width direction orthogonal to the sheet feeding direction. The curved portion 59*a* is positioned between the registration sensor 108 and the registration roller pair 240 in the sheet feeding direction. The sheet P set in the manual feed tray 13 disposed on a side portion of the printer body 201A is first fed in an approximately horizontal direction into the printer body 201A, and then guided upward along the curved portion 59*a* to reach the registration roller pair 240. Therefore, the sheet while passing the curved portion 59*a* of the conveyance path 59 is in a curved state along the curved portion 59*a*, and tends to receive a greater conveyance resistance compared to other portions of the conveyance path 59.

By the way, in the case of single-rotation feeding, as illustrated in FIG. 8A, after the leading edge of the sheet passes the detection position of the registration sensor 108, the drive of the manual feed drive motor M1 is stopped at a timing where the cam 50 rotates once (at time t4). Therefore, during the time from when the drive of the manual feed drive motor M1 is stopped to when the leading edge of the sheet reaches the registration roller pair 240 (time t4 to t5), the sheet entering the curved portion 59*a* of the conveyance path 59 is conveyed only by the drawing roller pair 106. Further, in a state where the manual feed drive motor M1 is stopped, the sheet is moved while the retard roller 18 is rotated in the forward direction, such that a force corresponding to the torque value of the torque limiter connected to the retard roller 18 will be added to the conveyance resistance.

If the conveyance resistance is high, the drawing roller pair 106 may slip on the sheet, possibly causing abnormalities such as conveyance delay and sheet jam. Then, the manual sheet feeder 300 according to the present embodiment executes the following double-rotation feeding depending on the situation.

Double-Rotation Feeding

Now, a double-rotation feeding will be described with reference to FIGS. 9A and 9B. The elements common to the above-described single-rotation feeding will be omitted. As illustrated in FIGS. 9A and 9B, in double-rotation feeding, after the manual feed drive motor M1 is started, the drive of the manual feed drive motor M1 is continued even after the HP sensor 78 has detected one rotation of the cam 50 (time t4 to tc). The manual feed drive motor M1 is stopped at a timing when the HP sensor 78 is turned ON for the next time (at time tc), that is, at a timing when the second rotation of the cam 50 is completed. In the illustrated example, the leading edge of the sheet reaches the registration roller pair 240 during the second rotation of the cam 50. Therefore, such a configuration is adopted that the driving of the manual feed drive motor M1 is temporarily stopped in synchronization with the drawing motor M2 before the second rotation of the cam 50 is completed, and thereafter, the drive motor M1 is restarted (time t5 through t6).

Thereby, at least while the pickup roller 16 is maintained in the abutment state by the second pickup operation, the force in the sheet feeding direction is applied to the sheet from the pickup roller 16. Therefore, by executing double-rotation feeding, the effect of conveyance resistance is reduced compared to the case where single-rotation feeding is performed, and stability of sheet conveyance is improved. Further, in a state where the manual feed drive motor M1 is stopped, the sheet feed unit 14 mainly acts as conveyance resistance by the operation of the torque limiter connected to the retard roller 18, but in double-rotation feeding, the driving period of the manual feed drive motor M1 is extended. Therefore, force in the sheet feeding direction is also applied from the feeding roller 17 on the sheet, and the stability of sheet conveyance is further improved.

However, if such double-rotation feeding is performed constantly, there were cases where the succeeding sheet stacked under the uppermost sheet may be picked up by the second pickup operation. For example, as illustrated in FIG. 9, in a state where a sheet having a small sheet length L1 in the sheet feeding direction, i.e., short sheet, is fed, a trailing edge of the uppermost sheet (refer to dashed line) reaches the position of the pickup roller 16 at a relatively early timing (at time ta). It is noted that the trailing edge of the sheet refers to an upstream end in the sheet feeding direction. In this case, during the time from when the trailing edge of the uppermost sheet passes the pickup roller 16 to the time when the pickup roller 16 moves toward the standby position (time ta to tb), the succeeding sheet will be undesirably fed by the pickup roller 16. Thereby, problems such as multiple feeding in which the uppermost sheet and the succeeding sheet are conveyed in an overlapped state or sheet jam tend to occur.

Figure 10A:
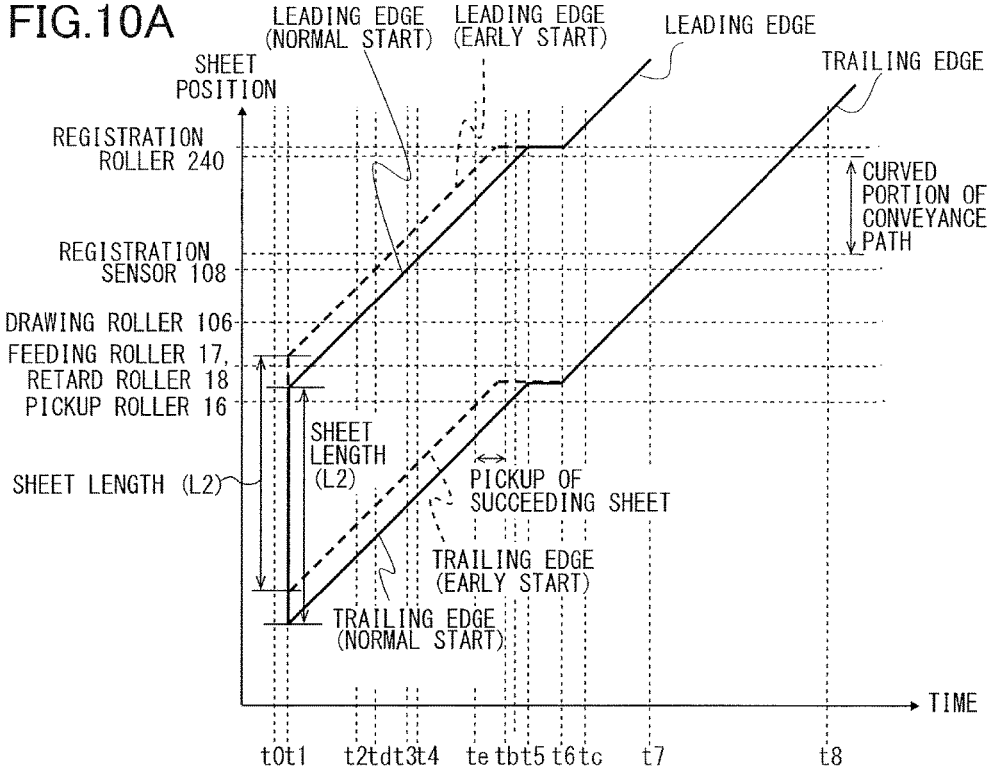
FIG. 10A is a graph illustrating positions of two sheets whose start positions differ in double-rotation feeding, in the manual sheet feeder according to the first embodiment.
Figure 10B:
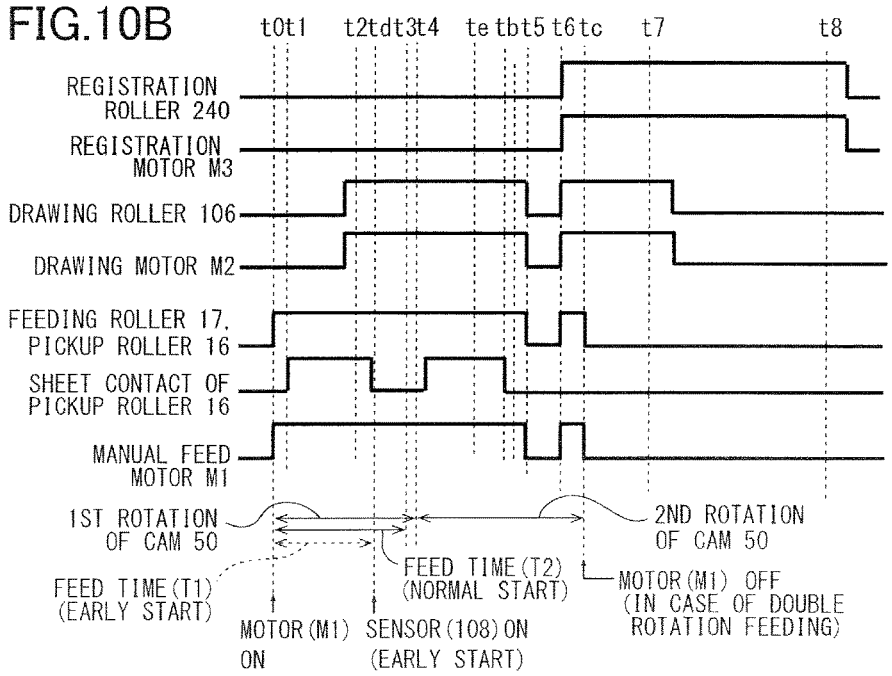
FIG. 10B is a timing chart of the double-rotation feeding.

Further, as illustrated in FIGS. 10A and 10B, even if the sheet length L2 is relatively long, there were cases where the succeeding sheet is undesirably picked up by the second pickup operation depending on the position of the sheet when the double-rotation feeding is started. As illustrated in FIG. 10A, there are cases where double-rotation feeding is started in a state where the uppermost sheet is positioned downstream in the sheet feeding direction than normal cases, such as in a case where the leading edge of the sheet is already in the separation portion 35 (refer to dashed line). In such a case, the trailing edge of the uppermost sheet may pass the pickup roller 16 at an earlier timing than usual (at time te), such that the succeeding sheet is fed by the pickup roller 16 undesirably.

Executing Condition of Double-Rotation Feeding

Figure 11:
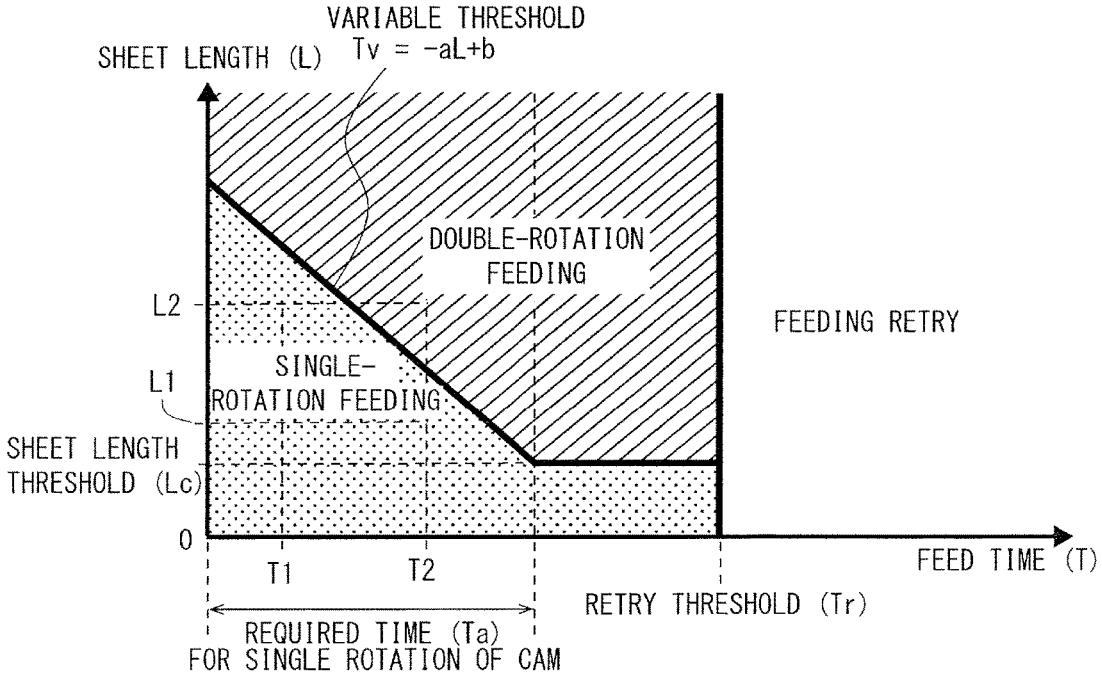
FIG. 11 is a chart illustrating conditions for executing double-rotation feeding in the manual sheet feeder according to the first embodiment.

Therefore, according to the present embodiment, as illustrated in FIG. 11, whether to enable execution of double-rotation feeding is determined based on information related to sheet position (feed time T) and length of sheet (sheet length L). However, feed time T refers to an elapse time from when the first feeding operation of the sheet feed unit 14 (first pickup operation) is started (T=0) to when the sheet is detected by the registration sensor 108.

Specifically, double-rotation feeding is executed in a state where the following conditions (1) through (3) are satisfied regarding the feed time T and the sheet length L.

$$\text{Feed Time}(T) > \text{Variable Threshold}(Tv) \quad (1)$$

$$\text{Feed Time}(T) < \text{Retry Threshold}(Tr) \quad (2)$$

$$\text{Sheet Length}(L) > \text{Sheet Length Threshold}(Lc) \quad (3)$$

The variable threshold Tv is a threshold set as boundary where pickup of the succeeding sheet may occur in a case where the second feeding operation (second pickup operation) is executed by the sheet feed unit 14, considering the sheet length L and a theoretical sheet conveyance speed by the sheet feed unit 14. The theoretical sheet conveyance speed is a sheet conveyance speed of the sheet feed unit 14 assuming that the pickup roller 16 and the feeding roller 17 do not slip on the sheet.

Therefore, the points on the straight line defined by the variable threshold Tv in FIG. 11 correspond to the combination of the sheet length L and the feed time T where the trailing edge of the uppermost sheet just passes the pickup roller 16 at a point of time when the second feeding operation is completed. It is noted that, in order to prevent pickup of the succeeding sheet more reliably, an appropriate margin is set to the variable threshold Tv with respect to the combination of sheet length L and feed time T.

In a state where a certain sheet reaches the registration sensor 108 during the first feeding operation, a maximum conveyance distance of the sheet, that is, a distance that the sheet may be moved at most under the second feeding operation, can be estimated using the theoretical sheet conveyance speed. Specifically, a sum of remaining time of the first feeding operation and required time of the second feeding operation should be multiplied by the theoretical sheet conveyance speed. The variable threshold Tv is a threshold time set such that the trailing edge of the sheet remains upstream of the pickup roller 16 in a state where the leading edge of the sheet is moved for the maximum conveyance distance from the detection position of the registration sensor 108.

The variable threshold Tv can be computed by a linear function expression as described below using constants a and b.

$$Tv=-aL+b$$

wherein constant "a" is determined based on the theoretical sheet conveyance speed of the sheet feed unit 14. Constant b is determined based on the theoretical sheet conveyance speed of the sheet feed unit 14, and the distance between the pickup roller 16 and the registration sensor 108 in the sheet feeding direction.

The retry threshold Tr in conditional expression (2) is a threshold for determining whether it is necessary to execute feeding operation again in a state where the leading edge of the sheet has not reached the detection position of the registration sensor 108 after the feeding operation has been started. In other words, the retry threshold Tr is a threshold time for determining a time-out state if the sheet has not reached a checkpoint within a predetermined time from the start of the feeding operation. The retry threshold Tr is set to a value greater than an elapsed time during which the cam 50 makes one rotation, that is, greater than a time Ta required for the sheet feed unit 14 to perform a feeding operation once.

The sheet length threshold Lc in the conditional expression (3) represents a lower limit of the sheet length capable of executing double-rotation feeding. If the sheet is extremely short, that is, if the sheet length is shorter than a theoretical conveyance length in a state where the sheet feed unit 14 executes double-rotation feeding, it is considered that the probability of picking up the succeeding sheet is high. Therefore, it is preferable to execute double-rotation feeding when a sheet having a sheet length equal to or greater than a certain reference length is fed, depending on the specific configuration of the sheet feeding apparatus. In other words, if a sheet having a length in the sheet feeding direction shorter than the reference length is fed, the sheet feeding apparatus is configured to execute a first feed mode, regardless of the time from when the first feed process is started to when the sheet is detected by the detection unit.

In the present embodiment, the sheet length threshold Lc is determined in advance based on a sheet conveyance speed by sheet feed unit 14, and the distance between the pickup roller 16 and the registration sensor 108 in the sheet feeding direction. Specifically, the sheet length of a case where the value of the variable threshold Tv is equivalent to time Ta required for one time of the feeding operation of the sheet feed unit 14 is set as the sheet length threshold Lc. This indicates that if the sheet having a sheet length Lc passes the registration sensor 108 simultaneously as the end of the first feeding operation, the trailing edge of the sheet will reach the pickup roller 16 simultaneously as the completion of the second feeding operation. Therefore, if the sheet has a length greater than Lc, and if the registration sensor 108 is detected before the first feeding operation is completed, the succeeding sheet will be prevented from being picked up even when performing the second feeding operation.

The value of the sheet length threshold Lc can be set smaller by arranging the distance between the registration sensor 108 and the pickup roller 16 in the sheet feeding direction to be small. In that case, the area of double-rotation feeding zone in FIG. 11 is expanded, that is, double-rotation feeding can be executed in a wide variety of conditions.

In FIG. 11, the area satisfying the conditional expressions (1) to (3) is an area where double-rotation feeding can be executed, i.e., double-rotation feeding zone, and the portion other than the area where $T<Tr$ and within the double-rotation feeding zone is an area where single-rotation feeding is executed, i.e., single-rotation feeding zone. That is, if the combination of feed time T and sheet length L is within the double-rotation feeding zone, the manual sheet feeder 300 executes double-rotation feeding under the condition that the other conditions such as the stiffness of the sheet are cleared in a case where the combination of the feed time T and the sheet length L is within the double-rotation feeding zone.

Further, the area where $T\geq Tr$ is an area where re-feeding operation is determined to be required by the control unit, i.e., feed retry zone. In other words, the manual sheet feeder 300 performs the feeding operation from the start again in a state where a time-out state occurs where the sheet is not detected by the registration sensor 108 within a set time determined in advance ($T<Tr$) after the first feeding operation has been started.

The present embodiment adopts a configuration in which the control unit starts retry of feeding operation when a time-out state is detected in the determination process using the retry threshold Tr, but the operation being performed when a time-out state is detected can be changed arbitrarily. For example, a configuration can be adopted where the feeding operation is interrupted and a warning message to a user is displayed on a display unit such as a liquid crystal panel.

Flowchart

Figure 12:
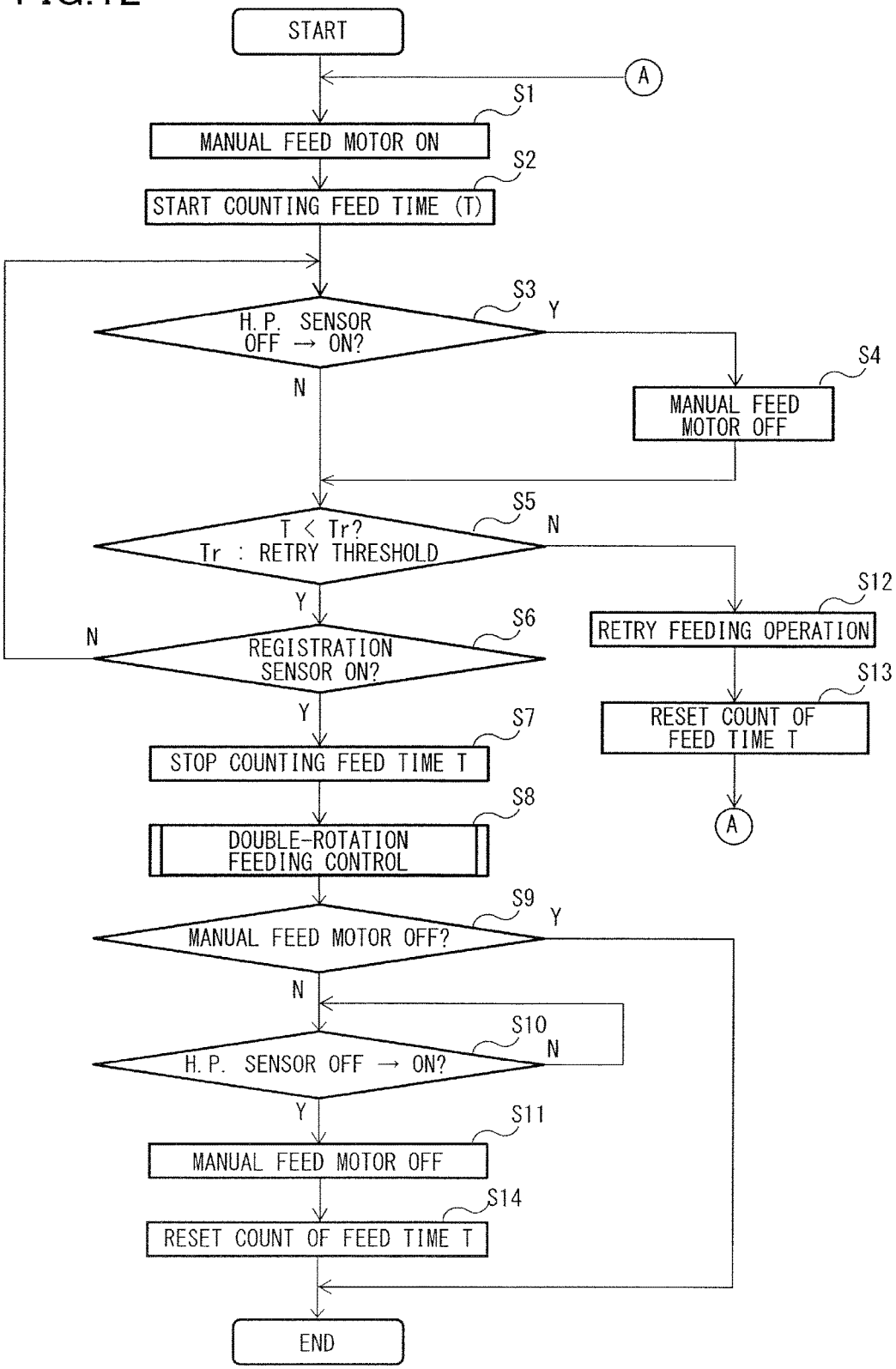
FIG. 12 is a flowchart illustrating a control process of the feeding operation according to the first embodiment.

Now, an example of a control process for selectively executing a single-rotation feeding or a double-rotation feeding to feed sheets according to the executing condition described above will be described with reference to the flowcharts illustrated in FIGS. 12 and 13. The respective steps described below are achieved by the CPU 261 mounted in the printer body 201A reading and executing programs stored in memories like a ROM 262 (refer to FIG.

3). The CPU 261 is an example of a processor constituting a control unit configured to control the operation of the sheet feeding apparatus.

In a state where starting of sheet feed is requested to the manual sheet feeder 300, at first, the manual feed drive motor M1 is started (S1), and simultaneously the counting of the feed time T is started (S2). Thereby, a first feeding operation by the sheet feed unit 14 is started. In other words, step S1 corresponds to a first feed process in which the control unit demands the sheet feed portion to execute the feeding operation.

Thereafter, the CPU 261 stands by until the leading edge of a sheet is detected by the registration sensor 108 (S6). If the HP sensor 78 detects that the cam has rotated once before the registration sensor 108 outputs an ON signal (S3: Y), the manual feed drive motor M1 is stopped (S4). Further, if the feed time T exceeds the retry threshold Tr before the registration sensor 108 outputs an ON signal (S5: N), a time-out state is determined, and the need to perform a retry feeding operation is determined (S12). In that case, the CPU 261 resets the count value of the feed time T (S13), and starts the feeding operation again.

If the ON signal of the registration sensor 108 is detected before the feed time T exceeds the retry threshold Tr (S6: Y), the count of the feed time T is stopped (S7). The CPU 261 uses the count value of the feed time T, and executes a double-rotation feeding control processing to determine whether the second feeding operation is executable or not (S8).

Figure 13:
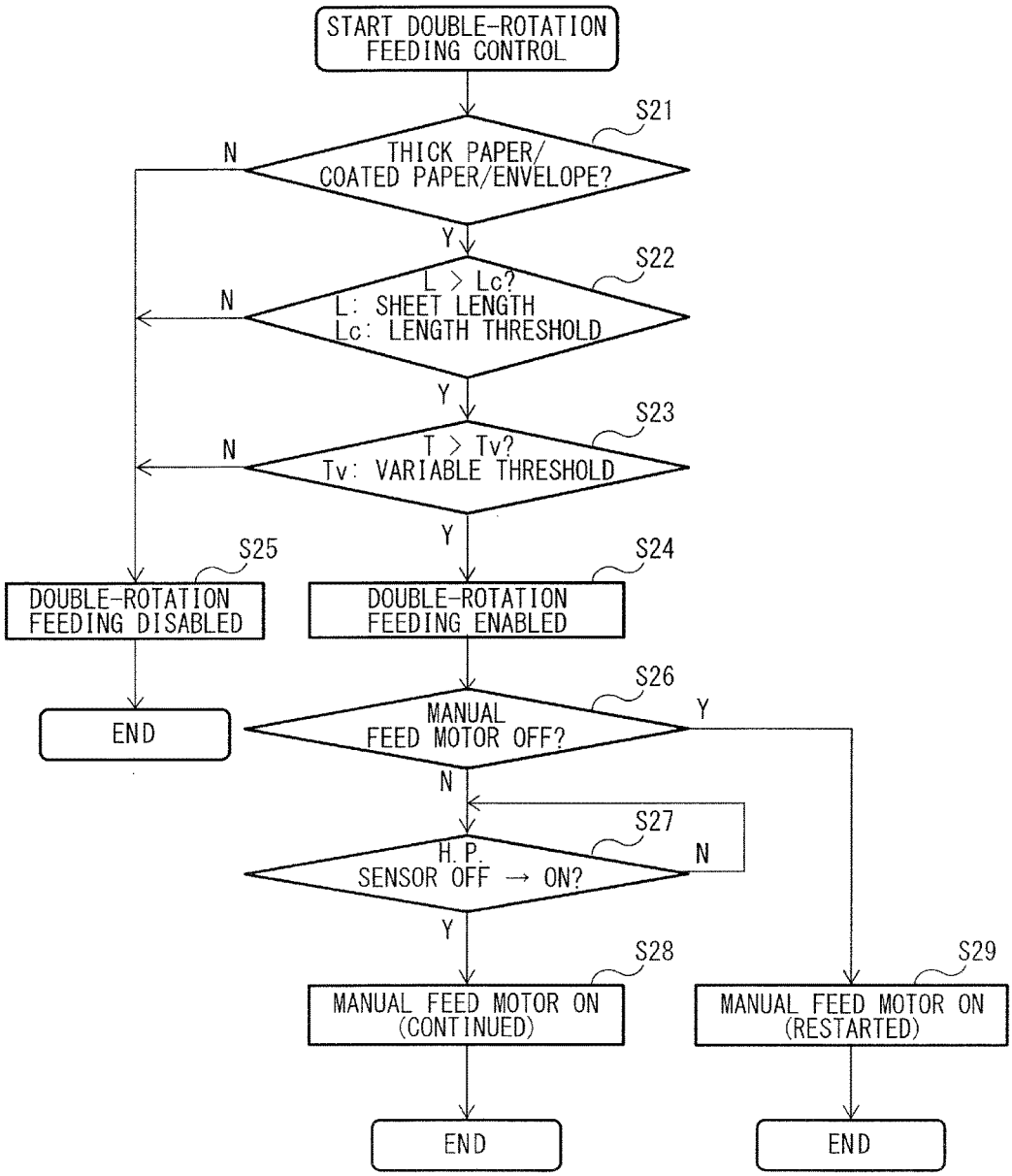
FIG. 13 is a flowchart illustrating contents of a double-rotation feeding control process according to the first embodiment.

As illustrated in FIG. 13, in the double-rotation feeding control processing, it is determined whether the sheet is a sheet type having a high stiffness, that is, whether the sheet is either a thick paper, a coated paper or an envelope (S21). Further, it is determined whether the sheet length L and the feed time T respectively exceed the sheet length threshold Lc and the variable threshold Tv (S22 and S23). If all of these determination criteria are cleared, the CPU 261 determines to execute a mode where double-rotation feeding is performed, i.e., a second feed mode (S24). If any one of the determination criteria are not cleared, the second feeding operation will not be executed, and a determination to execute a mode where sheets are fed by single-rotation feeding, i.e., a first feed mode, is set (S25). Information on whether the type of sheet has a high stiffness, or the length of the sheet, are entered in advance by the user through an operation unit such as an operation panel provided on the printer 201. The CPU 261 acquires the sheet size information based on the information entered by the user. It is also possible to provide a sensor configured to detect sheet length to the manual feed tray 13, and detect the length of the sheet supported on the manual feed tray 13 based on the output from the sensor.

If double-rotation feeding is to be executed, the procedure differs depending on whether the first feeding operation is completed. If the first feeding operation is on-going (S26: N), the CPU 261 waits until the HP sensor 78 detects that the cam 50 has rotated once (S27), and then continues to drive the manual feed drive motor M1 to start the second feeding operation (S28). If the first feeding operation is already completed (S26: Y), the CPU 261 immediately resumes drive of the manual feed drive motor M1, and executes the second feeding operation (S29). In other words, steps S28 and S29 correspond to a second feed process in which the control unit carries out another feeding operation by the sheet feed portion in addition to the first feed process.

As described, the CPU 261 ends the double-rotation feeding control processing in a state where the second feeding operation is started or in a state where the second feeding operation is determined not to be executed. As illustrated in FIG. 12, after performing the double-rotation feeding control processing (S8), if the first or the second feeding operation is not completed (S9: N), the CPU 261 waits for completion of the feeding operation (S10: Y) before stopping the manual feed drive motor M1 (S11). Then, the CPU 261 resets the count of the feed time T (S14), and ends the process. If the first feeding operation is already completed (S9: Y), the CPU 261 resets the count of the feed time T (S14) and ends the process. The feed time T is counted for each sheet being fed. The count of the feed time T should be reset after it is determined by the manual sheet feeder 300 that the feeding of the sheet has been completed. For example, the count should be reset based on detection of a sheet discharge sensor (not shown) configured to detect that image forming to a sheet has been completed and the sheet has been supported on the supporting portion 223.

Figure 9B:
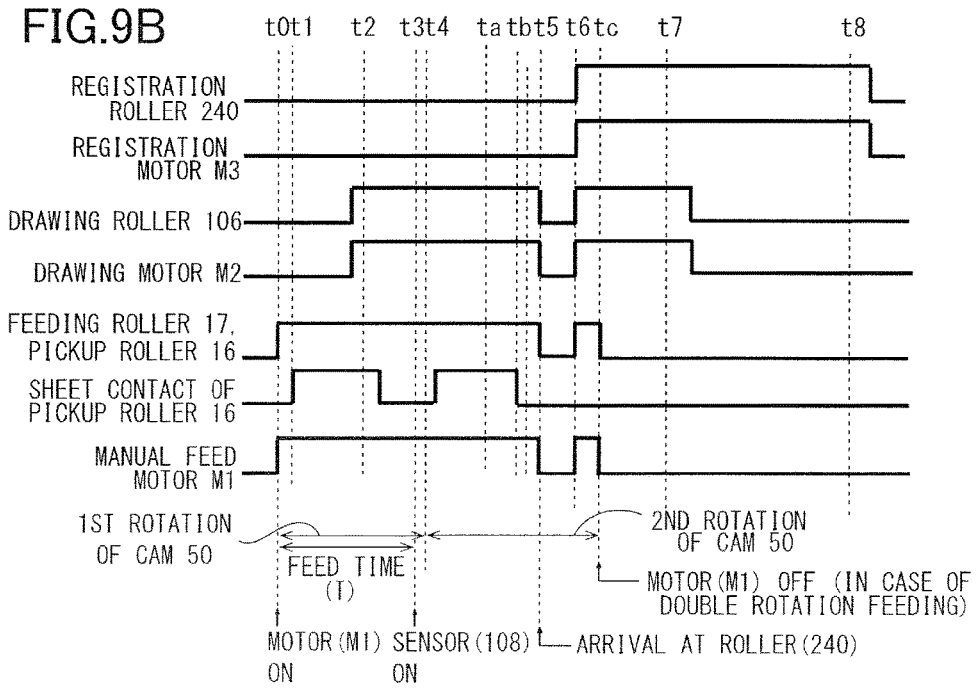
FIG. 9B is a timing chart of the double-rotation feeding.

Concurrently as the flowchart described above, drive control of the drawing motor M2 and the registration motor M3 are performed (refer to FIGS. 8B and 9B). Thereby, the sheet fed through single-rotation feeding or double-rotation feeding of the sheet feed unit 14 is passed on to the drawing roller pair 106 and the registration roller pair 240, and the sheet is fed to the image forming portion 201B.

As described, the manual sheet feeder 300 switches and executes single-rotation feeding and double-rotation feeding based on the detection timing of the registration sensor 108 serving as a detection unit. As illustrated in FIG. 11, as a result of such control, if a sheet having a certain length L2 is being fed, if the sheet is detected at a first timing, i.e., feed time T1, single-rotation feeding is executed. If the sheet is detected at a second timing, i.e., feed time T2, that is later than the first timing, double-rotation feeding is executed. In other words, when feeding a sheet having a certain length, i.e., first sheet, is fed, if the time from when the first feed process is started to when the sheet is detected by the detection unit is a first time length, e.g., the point (T1, L2) in FIG. 11, the first feed mode is selected, and if the time is a second time length longer than the first time length, e.g., the point (T2, L2) in FIG. 11, the second feed mode is executed.

Therefore, if the advancement of the sheet is relatively early, such as if the leading edge of the sheet has entered the separation portion at a point of time when the first feeding operation is started (refer to dashed line of FIG. 10A), the succeeding sheet is prevented from being picked up by not performing the second feeding operation. If the advancement of the sheet is relatively late and there is little possibility of picking up the succeeding sheet by performing the second feeding operation, double-rotation feeding is executed to improve sheet conveyance stability. Therefore, according to the present embodiment, the sheet conveyance stability can be improved while preventing occurrence of drawbacks such as multiple sheet feed caused by picking up the succeeding sheet.

Further, the manual sheet feeder 300 is configured to execute the double-rotation feeding if a relatively long sheet is being fed, without performing double-rotation feeding for sheets having a relatively short sheet length, as illustrated in FIG. 11. That is, if a sheet having a first length (e.g., L1), in the sheet feeding direction is fed, after the first feeding operation is completed, the sheet is conveyed in a state where the pickup roller 16 is retained in the standby position (FIG. 9A). If a sheet having a second length that is longer than the first length (e.g., L2) is fed, the second feeding operation is executed after executing the first feeding operation, while the sheet being conveyed by the drawing roller pair 106. In other words, if the time from when the first feed process is started to when the sheet is detected by the detection unit, i.e., third time period, is the same, the first feed mode is selected for a third sheet having a third length, e.g., the point (T2, L1) in FIG. 11, and the second feed mode is selected for a fourth sheet having a fourth length that is longer than the third length, e.g., the point (T2, L2) in FIG. 11. Therefore, the second feeding operation is not performed for a sheet having a relatively short length, thereby preventing the succeeding sheet from being picked up, while improving the sheet conveyance stability of feeding a relatively long sheet.

The variable threshold Tv serving as a threshold time related to feed time T is set to different values depending on sheet length L. The variable threshold Tv is set so that the value becomes smaller as the sheet length L becomes greater (refer to FIG. 11). In other words, the variable threshold Tv is set to a greater value when feeding a sheet having a first length compared to when feeding a sheet having a second length that is longer than the first length. Therefore, as for a short sheet where pickup of a succeeding sheet tends to occur when the second feeding operation is executed, double-rotation feeding is executed only when the advancement of the sheet is relatively slow, such that the succeeding sheet is prevented from being picked up. As for a long sheet having a relatively long length, double-rotation feeding is executed aggressively even if the advancement of the sheet is relatively quick, so that the sheet conveyance stability can be improved.

Especially, the variable threshold Tv is set considering the maximum conveyance distance of the sheet when the second feeding operation is performed, based on the sheet length L and the theoretical sheet conveyance speed of the sheet feed unit 14. Therefore, under the condition of preventing pickup of the succeeding sheet, the opportunity of having the sheet feed unit 14 execute double-rotation feeding can be maximized.

If the conveyance target sheet is thick paper, coated paper or envelope, the manual sheet feeder 300 executes double-rotation feeding. Therefore, during conveyance of a sheet having a high stiffness with high conveyance resistance, the second feeding operation enables to reduce the influence of the conveyance resistance. Thick paper, coated paper and envelope are assumed as sheets having a high stiffness according to the present embodiment, but a configuration can be adopted where double-rotation feeding is executed to only one or more of these sheet types. If a configuration is adopted to determine whether to execute the second feed process based on stiffness, similar control may be applied to sheet types other than those listed above. A similar effect can be achieved if double-rotation feeding is executable in a case where a sheet having a first stiffness is fed, and single-rotation feeding is executed in a case where a sheet having a second stiffness that is smaller than the first stiffness is fed.

Further, the present embodiment adopts a configuration in which the conveyance path 59 that guides the sheets includes the curved portion 59*a* that is curved at the downstream side of the registration sensor 108 when viewed from the width direction (refer to FIG. 7A). The curved portion 59*a* is positioned between the drawing roller pair 106 serving as the first conveyance member and the registration roller pair 240 serving as the second conveyance member, and the registration sensor 108 is arranged upstream from the center position of the roller pairs 106 and 240. Therefore, by executing the second feeding operation, the influence of the conveyance resistance at the curved portion can be reduced without changing the shape of the conveyance path.

In the present embodiment, the executing condition of double-rotation feeding is determined based on both the feed time T and the sheet length L, but the determination can also be performed by using only one of the two conditions. For example, if the range of sheet length acceptable by the manual sheet feeder 300 is determined, whether to perform double-rotation feeding can be determined based on the feed time T. Further, if the difference of feed time T is suppressed to a small value due to regulating members such as a shutter that regulates the position of the sheet supported on the manual feed tray in the sheet feeding direction, whether to perform double-rotation feeding can be determined based on the sheet length L.

Second Embodiment

Next, a configuration of a manual sheet feeder serving as a sheet feeding apparatus according to a second embodiment will be described. The manual sheet feeder according to the present embodiment differs from the first embodiment in conditions for executing double-rotation feeding, and other configurations are the same as the first embodiment. Therefore, elements that are common to the first embodiment are denoted with the same reference numbers as the first embodiment, and descriptions thereof are omitted.

Figure 14:
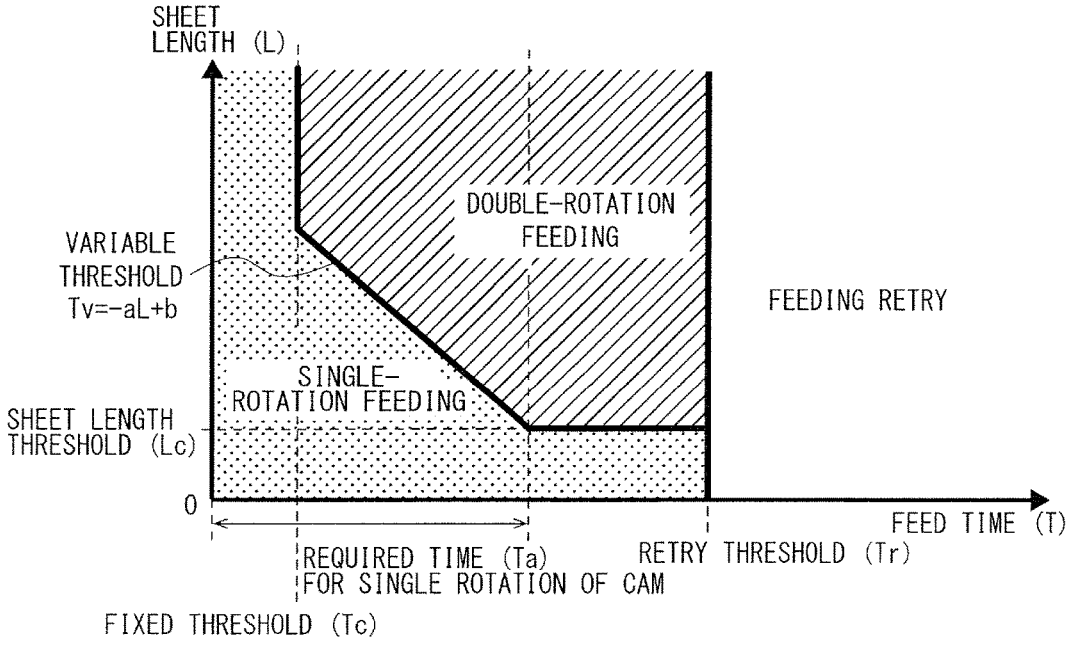
FIG. 14 is a chart illustrating conditions for performing double-rotation feeding in a manual sheet feeder according to a second embodiment.

As illustrated in FIG. 14, according to the present embodiment, double-rotation feeding is executed if the following conditional expression (4) is satisfied in addition to the condition expressions (1) through (3) of the first embodiment.

$$\text{Feed Time}(T) > \text{Fixed Threshold}(Tc) \quad (4)$$

The fixed threshold Tc is a reference time set in advance, and represents a lower limit of feed time T based on which double-rotation feeding can be executed. It is considered that if the feed time T is sufficiently small, that is, if the leading edge of the sheet has reached the registration sensor 108 at a sufficiently early time, the leading edge of the sheet should reach the registration sensor 108 without delay without performing the second feeding operation.

Therefore, by setting an appropriate value as the fixed threshold Tc, single-rotation feeding is executed if there is little need to perform the second feeding operation. In other words, if the time from when the first feed process is started to when the sheet is detected by the detection unit is smaller than a reference time, the sheet feeding apparatus is configured to execute the first feed mode regardless of the length of the sheet in the sheet feeding direction. Thereby, operating noise of the manual feed drive motor M1 or mechanical noise accompanying the pickup operation of the pickup roller 16 can be reduced while maintaining the effect of improved sheet conveyance stability by double-rotation feeding.

Figure 15:
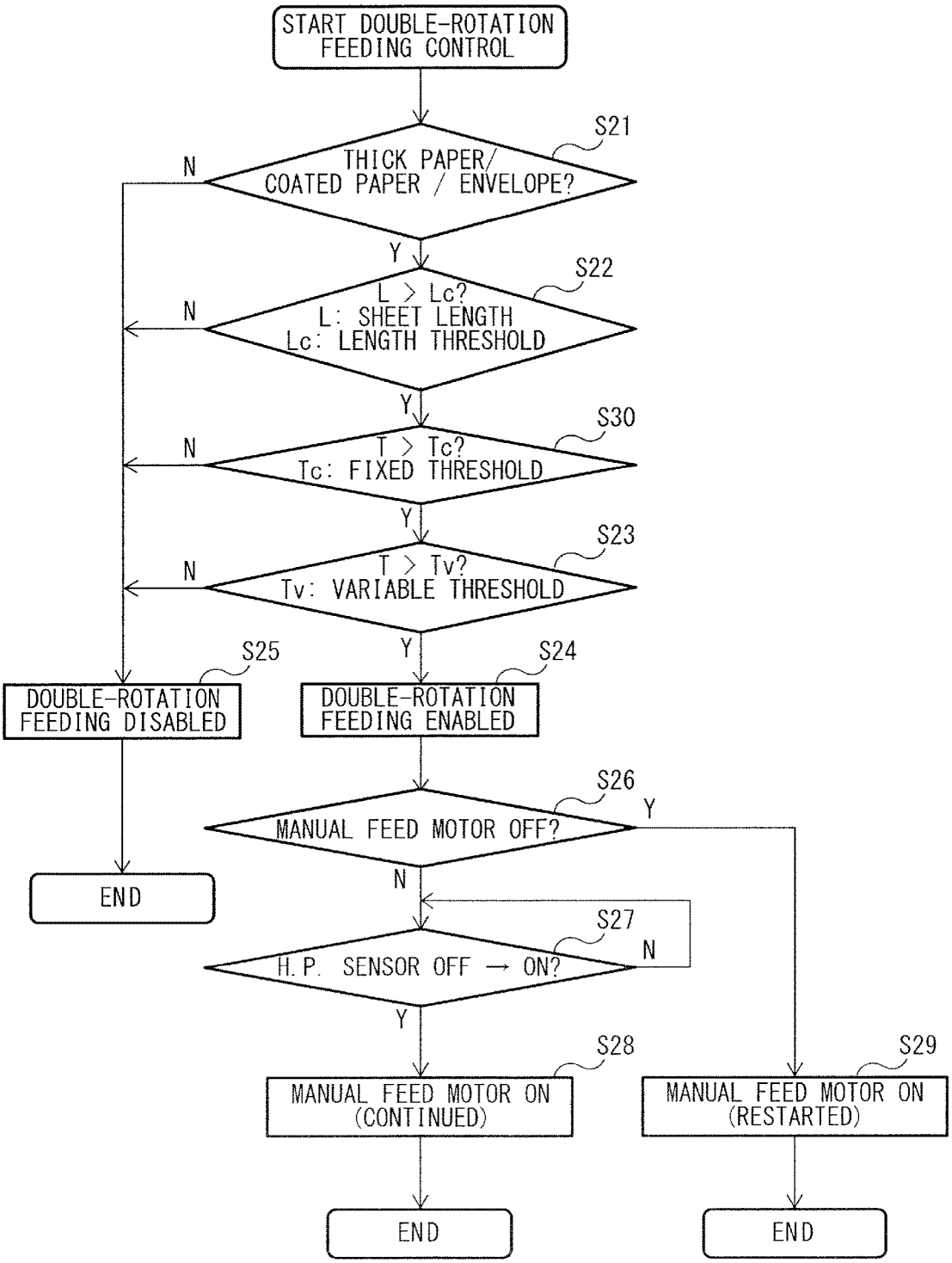
FIG. 15 is a flowchart illustrating contents of a double-rotation feeding control according to the second embodiment.

As illustrated in FIG. 15, the double-rotation feeding control process in accordance with the executing condition according to the present embodiment has inserted a determination step (S30) corresponding to the above-described conditional expression (4) to the process flow (FIG. 13) according to the first embodiment. That is, if the feed time T is greater than the fixed threshold Tc (S30: Y), the CPU 261 determines that the second feeding operation can be executed. The contents of the control process including the double-rotation feeding control processing and steps other than the above-described step S30 in the double-rotation feeding control processing are similar to the contents of processing according to the first embodiment.

Other Embodiments

In the first and second embodiments, the sheet feed unit 14 including the pickup roller 16 movable in the vertical direction has been described as an example of the sheet feed portion, but other types of sheet feed portion can also be used. For example, in a configuration where a liftable support plate is provided as the sheet supporting portion, it is possible to adopt a configuration where the lifting and lowering of the support plate causes a pickup roller to abut against or move away from the sheet. In this example, a lifting device such as a cam mechanism configured to lift and lower the support plate corresponds to the switching mechanism. Further, the configuration is not restricted to an arrangement where the pickup roller feeds sheets toward the separation portion, and a configuration can be adopted where the sheets are directly fed by a feed roller in contact with a pad-type or roller-type separation member. In this case, the feed roller corresponds to the pickup rotary member. Further, a feed roller, so-called a half-moon roller, having a D-shaped cross-sectional shape in which a portion of a cylindrical outer circumferential surface is cut away, can be used as the sheet feed portion. In this case, as a function of the sheet feed portion, the feed roller is switched between the contact state and the released state along with rotation, without depending on the switching mechanism such as the cam mechanism.

According to the above-described embodiment, an example has been described in which the feeding operation by the sheet feed unit 14 is performed once in each of the first and second feed processes, but a configuration can be adopted in which a plurality of feeding operations is executed in the respective feed processes. For example, in a state where the second feed process is executed, if there is sufficient sheet length, a plurality of feeding operations can be executed by the sheet feed unit 14 as the second feed process.

The manual sheet feeder 300 is an example of the sheet feeding apparatus, and the present technique can be applied to a sheet feeding apparatus including a sheet feed cassette attached in a drawable manner to the image forming apparatus body, or to other sheet feeding apparatuses such as an automatic document feeding apparatus of a copying machine. Further, the present technique can be applied to an image forming apparatus equipped with an ink-jet type or other types of image forming portions instead of the electrophotographic type image forming portion 201B.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the succeeding claims is to be accorded the broadest interpretation so as to encompass all such modifications and equivalent structures and functions.

This application claims the benefit of Japanese Patent Application No. 2016-214645, filed on Nov. 1, 2016, which is hereby incorporated by reference wherein in its entirety.

What is claimed is:

1. A sheet feeding apparatus comprising:

a sheet supporting portion configured to support a sheet;

a sheet feed portion comprising a pickup rotary member switchable between a contact state of being in contact with the sheet supported on the sheet supporting portion and a released state of being released from the contact state, the sheet feed portion being configured to feed the sheet supported on the sheet supporting portion by performing a pickup operation in a cycle in which the pickup rotary member is switched from the released state to the contact state and then switched to the released state;

a sheet conveyance portion arranged downstream of the sheet feed portion in a sheet feeding direction of the sheet feed portion and configured to convey the sheet;

a detection unit arranged downstream of the sheet feed portion in the sheet feeding direction and configured to detect the sheet; and a sheet length acquirer configured to acquire information of a length of the sheet in the sheet feeding direction of the sheet feed portion; and a control unit comprising a processor and configured to control the sheet feed portion and the sheet conveyance portion, the control unit being configured to execute one of a plurality of modes including a first feed mode in which a first feed process of carrying out a pickup operation by the sheet feed portion is executed, the pickup rotary member being retained in the released state after the first feed process in the first feed mode, and a second feed mode in which the first feed process is executed, and then a second feed process of carrying out a pickup operation by the sheet feed portion is executed, wherein in a case where the sheet is detected by the detection unit during a period from a start to an end of the first feed process, the control unit is configured to determine a mode to be executed among the plurality of modes based on a time from when the first feed process is started to when the sheet is detected by the detection unit and the length of the sheet acquired through the sheet length acquirer.

2. The sheet feeding apparatus according to claim 1, wherein in a case of feeding a first sheet whose length in the sheet feeding direction is a first length, the control unit is configured to execute the first feed mode if a time from when the first feed process for feeding the first sheet is started to when the first sheet is detected by the detection unit is a first time length, and the second feed mode if the time from when the first feed process for feeding the first sheet is started to when the first sheet is detected by the detection unit is a second time length longer than the first time length.

3. The sheet feeding apparatus according to claim 2, wherein in a case of feeding a second sheet whose length in the sheet feeding direction is a second length longer than the first length, the control unit is configured to execute the second feed mode if a time from when the first feed process for feeding the second sheet is started to when the second sheet is detected by the detection unit is the first time length.

4. The sheet feeding apparatus according to claim 1, wherein in a case of feeding a third sheet whose length in the sheet feeding direction is a third length or a fourth sheet whose length in the sheet feeding direction is a fourth length longer than the third length, the control unit is configured to execute the first feed mode if a time from when the first feed process for feeding the third sheet is started to when the third sheet is detected by the detection unit is a third time period, and the second feed mode if a time from when the first feed process for feeding the fourth sheet is started to when the fourth sheet is detected by the detection unit is the third time period.

5. The sheet feeding apparatus according to claim 1, wherein the control unit is configured to execute either one of the first and second feed modes depending on the time from when the first feed process is started to when the sheet is detected by the detection unit in a case of feeding a sheet whose length in the sheet feeding direction is longer than a reference length, and the first feed mode regardless of the time from when the first feed process is started to when the sheet is detected by the detection unit in a case of feeding a sheet whose length in the sheet feeding direction is shorter than the reference length.

6. The sheet feeding apparatus according to claim 1, wherein the control unit is configured to execute the second feed mode if the time from when the first feed process is started to when the sheet is detected by the detection unit is greater than a threshold time, and wherein the threshold time is set to different values depending on the length of the sheet in the sheet feeding direction such that a value of the threshold time in a case where the length of the sheet is a first length is greater than that in a case where the length of the sheet is a second length longer than the first length.

7. The sheet feeding apparatus according to claim 6, wherein the values of the threshold time is set such that an upstream end of the sheet in the sheet feeding direction remains upstream of the sheet feed portion in a state where a downstream end of the sheet is moved from a detection position of the detection unit by a distance that the sheet feed portion can convey the sheet at most by the second feed process.

8. The sheet feeding apparatus according to claim 1, wherein the control unit is configured to execute either one of the first and second feed modes depending on the length of the sheet in the sheet feeding direction if the time from when the first feed process is started to when the sheet is detected by the detection unit is greater than a reference time, and the first feed mode regardless of the length of the sheet in the sheet feeding direction if the time from when the first feed process is started to when the sheet is detected by the detection unit is smaller than the reference time.

9. The sheet feeding apparatus according to claim 1, wherein the control unit is configured to execute either one of the first and second feed modes in a case of feeding a sheet having a first stiffness, and the first feed mode in a case of feeding a sheet having a second stiffness lower than the first stiffness.

10. The sheet feeding apparatus according to claim 1, wherein the control unit is configured to execute the second feed mode in a case where the sheet supported by the sheet supporting portion is a thick paper, a coated paper, or an envelope.

11. The sheet feeding apparatus according to claim 1, further comprising a conveyance guide forming a conveyance path that is configured to guide the sheet conveyed by the sheet conveyance portion, wherein the conveyance path comprises a curved portion which is curved when viewed from a width direction orthogonal to the sheet feeding direction and which is at least partially disposed downstream of a detection position of the detection unit in the sheet feeding direction.

12. The sheet feeding apparatus according to claim 11, wherein the sheet conveyance portion comprises a first conveyance member and a second conveyance member arranged downstream of the first conveyance member in the sheet feeding direction, wherein the conveyance path is curved between the first conveyance member and the second conveyance member when viewed from the width direction, and wherein the detection position of the detection unit is arranged upstream of a middle position between the first conveyance member and the second conveyance member in the sheet feeding direction.

13. The sheet feeding apparatus according to claim 1, wherein the control unit is configured to execute a determination process in which a time-out is determined if the sheet is not detected by the detection unit from when the first feed process is started until when a predetermined time has elapsed, the predetermined time being set longer than a time required from a start to an end of the first feed process, and wherein the control unit is configured to execute the second feed mode if following conditions (i) and (ii) are satisfied:

(i) the sheet is detected, in a state where the time-out is not determined, by the detection unit after the first feed process is ended; and (ii) the length of the sheet is longer than a predetermined reference length.

14. The sheet feeding apparatus according to claim 13, wherein the control unit is configured to start the first feed process again if the time-out is determined by the determination process.

15. The sheet feeding apparatus according to claim 1, further comprising a driving unit configured to drive the sheet feed portion, wherein in a case where an execution of the second feed mode is determined before the first feed process is ended, the control unit is configured to start the second feed process in continuation to the first feed process with the drive unit continuously driving the sheet feed portion.

16. The sheet feeding apparatus according to claim 1, further comprising:

a driving unit configured to drive the sheet feed portion; and a switching mechanism configured to be driven by the driving unit and move the pickup rotary member and the sheet supporting portion relatively, so as to switch the pickup rotary member between the contact state and the released state.

17. The sheet feeding apparatus according to claim 16, further comprising a retaining portion configured to be moved in a vertical direction while retaining the pickup rotary member, wherein the switching mechanism comprises a cam configured to be rotated by the driving unit, and a cam follower disposed between the cam and the retaining portion and configured to move the retaining portion in the vertical direction periodically with respect to a rotation amount of the cam.

18. The sheet feeding apparatus according to claim 17, further comprising a position detection unit configured to detect a position of the cam, wherein the control unit is configured to determine one cycle of a pickup operation by the sheet feed portion based on a detection result by the position detection unit.

19. The sheet feeding apparatus according to claim 1, wherein the pickup rotary member is a pickup roller, and wherein the sheet feed portion comprises a conveyance roller arranged downstream of the pickup roller in the sheet feeding direction and configured to convey the sheet downstream in the sheet feeding direction, and a separation member in contact with the conveyance roller and configured to separate the sheet conveyed by the conveyance roller from other sheets.

20. A sheet feeding apparatus comprising:

a sheet supporting portion configured to support a sheet;

a sheet feed portion comprising a pickup rotary member switchable between a contact state of being in contact with the sheet supported on the sheet supporting portion and a released state of being released from the contact state, the sheet feed portion being configured to feed the sheet supported on the sheet supporting portion by performing a pickup operation in a cycle in which the pickup rotary member is switched from the released state to the contact state and then switched to the released state;

a sheet conveyance portion arranged downstream of the sheet feed portion in a sheet feeding direction of the sheet feed portion and configured to convey the sheet;

a sheet length acquirer configured to acquire information of a length of the sheet in the sheet feeding direction of the sheet feed portion; and a control unit comprising a processor and configured to control the sheet feed portion and the sheet conveyance portion, the control unit being configured to execute one of a plurality of modes including a first feed mode in which a first feed process of carrying out a pickup operation by the sheet feed portion is executed, the pickup rotary member being retained in the released state after the first feed process in the first feed mode, and a second feed mode in which the first feed process is executed, and then a second feed process of carrying out a pickup operation by the sheet feed portion is executed, wherein the control unit is configured to determine a mode to be executed among the plurality of modes based on the length of the sheet acquired through the sheet length acquirer, such that the first feed mode is executed in a case of feeding a sheet having a first length in the sheet feeding direction and that the second feed mode is executed in a case of feeding a sheet having a second length longer than the first length in the sheet feeding direction.

21. An image forming apparatus comprising:

an image forming portion configured to form an image on a sheet; and a sheet feeding apparatus configured to feed the sheet to the image forming portion, the sheet feeding apparatus comprising:

a sheet supporting portion configured to support a sheet;

a sheet feed portion comprising a pickup rotary member switchable between a contact state of being in contact with the sheet supported on the sheet supporting portion and a released state of being released from the contact state, the sheet feed portion being configured to feed the sheet supported on the sheet supporting portion by performing a pickup operation in a cycle in which the pickup rotary member is switched from the released state to the contact state and then switched to the released state;

a sheet conveyance portion arranged downstream of the sheet feed portion in a sheet feeding direction of the sheet feed portion and configured to convey the sheet;

a detection unit arranged downstream of the sheet feed portion in the sheet feeding direction and configured to detect the sheet;

a sheet length acquirer configured to acquire information of a length of the sheet in the sheet feeding direction of the sheet feed portion; and a control unit comprising a processor and configured to control the sheet feed portion and the sheet conveyance portion, the control unit being configured to execute one of a plurality of modes including a first feed mode in which a first feed process of carrying out a pickup operation by the sheet feed portion is executed, the pickup rotary member being retained in the released state after the first feed process in the first feed mode, and a second feed mode in which the first feed process is executed, and then a second feed process of carrying out a pickup operation by the sheet feed portion is executed, wherein in a case where the sheet is detected by the detection unit during a period from a start to an end of the first feed process, the control unit is configured to determine a mode to be executed among the plurality of modes based on a time from when the first feed process is started to when the sheet is detected by the detection unit and the length of the sheet acquired through the sheet length acquirer.

22. The sheet feeding apparatus according to claim 1, wherein the sheet length acquirer comprises an operation unit through which a user can enter information on the length of the sheet supported on the sheet support portion.

23. The sheet feeding apparatus according to claim 1, wherein the sheet length acquirer comprises a sensor provided on the sheet support portion and configured to detect the length of the sheet supported on the sheet support portion and output a signal for the control unit.

* * * * *